US011918847B2

(12) United States Patent
Fima

(10) Patent No.: US 11,918,847 B2
(45) Date of Patent: Mar. 5, 2024

(54) BRAKING AND LOCKING SYSTEM FOR A TREADMILL

(71) Applicant: The Giovanni Project LLC, Carlsbad, CA (US)

(72) Inventor: Giovanni Raoul Fima, San Diego, CA (US)

(73) Assignee: The Giovanni Project LLC, Carlsbad, CA (US)

( * ) Notice: Subject to any disclaimer, the term of this patent is extended or adjusted under 35 U.S.C. 154(b) by 0 days.

(21) Appl. No.: 18/371,301

(22) Filed: Sep. 21, 2023

(65) Prior Publication Data

US 2024/0009508 A1 Jan. 11, 2024

Related U.S. Application Data

(60) Continuation-in-part of application No. 18/175,026, filed on Feb. 27, 2023, now Pat. No. 11,794,069, (Continued)

(51) Int. Cl.
*A63B 22/02* (2006.01)
*A63B 24/00* (2006.01)
(Continued)

(52) U.S. Cl.
CPC ..... *A63B 22/02* (2013.01); *A63B 24/0087* (2013.01); *A63B 2071/0081* (2013.01);
(Continued)

(58) Field of Classification Search
CPC . A63B 22/02; A63B 24/0087; A63B 71/0622; A63B 2071/0081; A63B 2207/02; A63B 2220/833
See application file for complete search history.

(56) References Cited

U.S. PATENT DOCUMENTS 4,411,424 A 10/1983 Barnett
4,519,603 A 5/1985 DeCloux
(Continued)

FOREIGN PATENT DOCUMENTS

CN 202777636 U 3/2013
CN 202834829 U 3/2013
(Continued)

OTHER PUBLICATIONS

"Operating and Maintaining the P30 Console" https://www.precor.com/sites/default/files/manuals/TRM_833_Manuals_EN.pdf Jun. 2011.
(Continued)

*Primary Examiner* — Joshua Lee
(74) *Attorney, Agent, or Firm* — Young Basile Hanlon & MacFarlane, P.C.

(57) ABSTRACT

An auto lock system for a manual treadmill, the auto lock system having a locking mechanism comprising a movable arm having a distal end facing one of the front axle or the rear axle, a locking device at the distal end of the movable arm configured to engage the one of the front axle or the rear axle to inhibit rotation of respective front wheels or rear wheels, and an actuator configured to move the movable arm. A controller is in communication with a sensor configured to detect a user on the tread. The controller is configured to, in response to the sensor detecting no user on the manual treadmill, actuate the actuator to move the movable arm such that the locking device engages the one of the front axle or the rear axle.

23 Claims, 25 Drawing Sheets

Related U.S. Application Data which is a continuation of application No. 16/922,621, filed on Jul. 7, 2020, now Pat. No. 11,590,388, which is a division of application No. 16/791,418, filed on Feb. 14, 2020, now Pat. No. 10,758,775, which is a continuation-in-part of application No. 16/433,230, filed on Jun. 6, 2019, now Pat. No. 10,569,152, which is a continuation of application No. 16/418,234, filed on May 21, 2019, now Pat. No. 10,556,168.

(60) Provisional application No. 62/919,155, filed on Feb. 28, 2019, provisional application No. 62/762,818, filed on May 21, 2018.

(51) Int. Cl.
*A63B 71/00* (2006.01)
*A63B 71/06* (2006.01)

(52) U.S. Cl.
CPC ..... *A63B 71/0622* (2013.01); *A63B 2220/833* (2013.01); *A63B 2225/74* (2020.08)

(56) References Cited

U.S. PATENT DOCUMENTS 4,564,191 A 1/1986 Atkin
4,927,136 A 5/1990 Leask
5,207,621 A 5/1993 Koch et al.
5,368,532 A * 11/1994 Farnet ..... A63B 22/02 482/54
5,385,520 A 1/1995 Lepine et al.
5,492,513 A 2/1996 Wang
5,584,779 A 12/1996 Knecht et al.
5,769,755 A 6/1998 Henry et al.
5,993,358 A 11/1999 Gureghian et al.
6,010,465 A 1/2000 Nashner
6,123,647 A 9/2000 Mitchell
6,626,803 B1 * 9/2003 Oglesby ..... A63B 22/02 482/54
6,682,461 B2 1/2004 Wang et al.
6,783,482 B2 * 8/2004 Oglesby ..... A63B 22/025 482/54
7,070,542 B2 7/2006 Reyes et al.
7,419,175 B2 * 9/2008 Smith ..... B62M 1/34 482/54
7,604,571 B2 10/2009 Wilkins et al.
7,713,172 B2 * 5/2010 Watterson ..... A63B 71/0622 482/4
7,736,278 B2 6/2010 Lull et al.
7,833,133 B2 11/2010 Stewart et al.
7,854,177 B2 12/2010 Hamady
7,862,483 B2 * 1/2011 Hendrickson ..... A63B 22/0023 482/52
7,922,625 B2 4/2011 Grind
8,192,329 B2 6/2012 Saitou et al.
8,221,292 B2 7/2012 Barker et al.
8,317,663 B2 11/2012 Stewart et al.
8,435,160 B1 5/2013 Clum et al.
8,480,541 B1 7/2013 Brunts
8,534,444 B2 9/2013 Senger
8,689,948 B2 4/2014 Winkler
8,784,278 B2 7/2014 Flake et al.
8,840,572 B2 9/2014 Whalen et al.
8,920,347 B2 12/2014 Bayerlein et al.
9,186,552 B1 * 11/2015 Deal ..... A63B 71/0619
9,430,920 B2 8/2016 Munro et al.
9,604,099 B2 3/2017 Taylor
9,623,281 B2 * 4/2017 Hendrickson ..... A63B 22/0023
9,675,839 B2 6/2017 Dalebout et al.
9,694,234 B2 7/2017 Dalebout et al.
9,922,528 B2 3/2018 Munro et al.
9,981,157 B2 5/2018 Bayerlein et al.
10,052,518 B2 8/2018 Lagree
10,207,146 B2 2/2019 Liao et al.
10,286,286 B1 * 5/2019 Ryan ..... A63B 71/0054
10,493,349 B2 12/2019 Watterson
10,816,177 B1 10/2020 Bayerlein et al.
11,123,602 B2 * 9/2021 Kueker ..... A63B 22/0235
11,338,188 B2 * 5/2022 Kueker ..... A63B 22/0257
2002/0045517 A1 * 4/2002 Oglesby ..... A63B 22/0242 482/51
2005/0026750 A1 * 2/2005 Oglesby ..... A63B 24/0006 482/4
2005/0039541 A1 2/2005 Kurono
2006/0019783 A1 1/2006 Hoag
2006/0035757 A1 2/2006 Flick et al.
2007/0032353 A1 2/2007 Wilkins et al.
2007/0201727 A1 8/2007 Birrell et al.
2008/0001772 A1 1/2008 Saito
2008/0039289 A1 * 2/2008 Smith ..... B62M 1/34 482/54
2009/0036272 A1 2/2009 Yoo
2009/0036273 A1 2/2009 Reyes et al.
2009/0137367 A1 * 5/2009 Hendrickson ..... A63B 21/0051 482/54
2010/0093492 A1 * 4/2010 Watterson ..... A63B 22/0242 482/4
2010/0160115 A1 * 6/2010 Morris ..... A63B 22/0235 482/4
2010/0216599 A1 8/2010 Watterson et al.
2012/0010053 A1 * 1/2012 Bayerlein ..... A63B 22/0017 482/54
2012/0021873 A1 1/2012 Brunner
2014/0011642 A1 * 1/2014 Astilean ..... A63B 22/02 482/54
2014/0066263 A1 3/2014 Huang et al.
2015/0352400 A1 12/2015 Bayerlein et al.
2016/0166877 A1 * 6/2016 Cei ..... A63B 22/0285 482/54
2016/0213976 A1 7/2016 So et al.
2017/0106222 A1 4/2017 Mayer et al.
2017/0136289 A1 5/2017 Frank
2017/0182356 A1 * 6/2017 Cei ..... A63B 21/157
2017/0266533 A1 9/2017 Dalebout et al.
2017/0266534 A1 9/2017 Watterson
2017/0266535 A1 9/2017 Watterson
2017/0333747 A1 11/2017 Athey
2018/0001134 A1 * 1/2018 Bayerlein ..... A63B 22/025
2018/0093130 A1 4/2018 Wagner
2018/0126248 A1 5/2018 Dion et al.
2018/0140903 A1 5/2018 Poure et al.
2018/0154209 A1 * 6/2018 Watterson ..... A63B 22/0242
2018/0185699 A1 * 7/2018 Kueker ..... A63B 71/0054
2018/0214730 A1 8/2018 Larose et al.
2018/0243611 A1 * 8/2018 Bradley ..... A63B 71/0054
2018/0308334 A1 10/2018 Minocha
2019/0009128 A1 1/2019 Yoo
2019/0054344 A1 2/2019 Athey et al.
2019/0168066 A1 6/2019 Yoo et al.
2019/0168067 A1 6/2019 Bates et al.
2019/0217182 A1 * 7/2019 Kueker ..... A63B 71/0054
2020/0129837 A1 4/2020 Liao et al.
2020/0332990 A1 10/2020 Bayerlein et al.
2021/0041092 A1 2/2021 Bayerlein et al.

FOREIGN PATENT DOCUMENTS

CN 203507440 U 4/2014
CN 205665807 U 10/2016
CN 107029383 A 8/2017
CN 206613083 U 11/2017
CN 107899183 A 4/2018
CN 108031061 A 5/2018
CN 108355304 A 8/2018
CN 108452480 A 8/2018
CN 108905060 A 11/2018
CN 208049266 U 11/2018
CN 109381837 A 2/2019
DE 4027317 C1 12/1991
EP 0858358 B1 9/2000
EP 2562666 A2 2/2013

(56) References Cited

FOREIGN PATENT DOCUMENTS

| | | | |
|---|---|---|---|
| GB | 2467359 | A | 8/2010 |
| KR | 200292457 | Y1 | 10/2002 |
| KR | 200358992 | Y1 | 8/2004 |
| KR | 20070012347 | A | 1/2007 |
| KR | 20080016223 | A | 2/2008 |
| KR | 101321182 | B1 | 10/2013 |
| KR | 101345798 | B1 | 12/2013 |
| KR | 101852748 | B1 | 6/2018 |
| WO | 9952601 | A1 | 10/1999 |
| WO | 2010124267 | A1 | 10/2010 |
| WO | 2018106598 | A1 | 6/2018 |
| WO | 2019028657 | A1 | 2/2019 |

OTHER PUBLICATIONS

Simon Fraser University "Two-Axis Circular Treadmill for Human Perception" May 5, 2010 http://www.sfu.ca/~ber1/web/iSpaceMecha/HoyleNaugleBrosasArzanpourWangRiecke_2010_CSME_ConferencePaper_Two-Axis_Circular_Treadmill_for_Human_Perception_and_Behaviour_Research_in_Virtual_Environments.pdf.

International Search Report and Written Opinion of corresponding application PCT/US2019/035991, dated Nov. 29, 2019; 11 pages.

Move Safety Device for Treadmills (Patented & Registered); YouTube; Sep. 15, 2009; https://www.youtube.com/watch?app=desktop&v=0UqKe9uA2DI.

* cited by examiner

BRAKING AND LOCKING SYSTEM FOR A TREADMILL

CROSS-REFERENCE TO RELATED APPLICATIONS

This application is a continuation-in-part of U.S. patent application Ser. No. 18/175,026, filed on Feb. 27, 2023, which is a continuation of U.S. patent application Ser. No. 16/922,621, filed on Jul. 7, 2020, now U.S. Pat. No. 11,590,388, which is a divisional application of U.S. patent application Ser. No. 16/791,418, filed on Feb. 14, 2020, now U.S. Pat. No. 10,758,775, which is a continuation-in-part of U.S. patent application Ser. No. 16/433,230 filed on Jun. 6, 2019, now U.S. Pat. No. 10,569,152, which is a continuation of U.S. patent application Ser. No. 16/418,234 filed on May 21, 2019, now U.S. Pat. No. 10,556,168, which claims priority to and the benefit of U.S. Provisional Application No. 62/762,818, filed May 21, 2018 and U.S. Provisional Application No. 62/919,155, filed Feb. 28, 2019, the entire disclosures of which are hereby incorporated by reference.

TECHNICAL FIELD

This disclosure relates to exercise equipment including motor driven and manual treadmills and to improvements thereof.

BACKGROUND

Exercise treadmills allow people to walk, jog, run, or sprint on a stationary machine with a moving tread. Treadmill treads can include a continuous belt or a slatted belt. The treads of both motorized treadmills that move the tread using a motor and manual treadmills that rely on the user to move the tread continue to move once a user of the treadmill has stepped off the tread. The moving tread can make it difficult for the user to continue using the treadmill once the user continues to operate the treadmill. Additionally, other individuals nearby the moving tread may step onto the tread unaware that it is moving. Motorized and manual treadmills also allow unauthorized users such as children or animals to step onto the tread during or after use by an authorized user. Further, motorized and manual treadmills do not provide an alert to nearby individuals that the tread is moving.

Motorized and manual treadmills also often display information to users using a display screen. Such displays may be ineffective means to relay information to the user of the treadmill or to observers of the user while the user is operating the treadmill.

SUMMARY

One aspect of this disclosure is an auto lock system for a manual treadmill, the auto lock system having a locking mechanism comprising a movable arm having a distal end facing one of the front axle or the rear axle, a locking device at the distal end of the movable arm configured to engage the one of the front axle or the rear axle to inhibit rotation of respective front wheels or rear wheels, and an actuator configured to move the movable arm. A controller is in communication with a sensor configured to detect a user on the tread. The controller is configured to, in response to the sensor detecting no user on the manual treadmill, actuate the actuator to move the movable arm such that the locking device engages the one of the front axle or the rear axle.

The locking device can comprise a first member extending from the distal end of the movable arm and having a first surface carrying a first magnet and a first distal surface configured to engage the one of the front axle or the rear axle and a second member extending from the distal end of the movable arm and having a second surface carrying a second magnet a second distal surface configured to engage the one of the front axle or the rear axle, the first surface facing the second surface to form a channel. The auto lock system can further comprise a flange surrounding the one of the front axle or the rear axle and aligned with the channel. The controller can be further configured to, in response to the sensor detecting no user on the manual treadmill, actuate the actuator to move the movable arm such that the flange is received in the channel, the first magnet and the second magnet slowing rotation of the one of the front axle or the rear axle via magnetic force on the flange, and, when the rotation of the one of the first axle or the second axle slows to a threshold amount, further actuate the actuator to move the movable arm so that the first distal surface and the second distal surface engage the one of the front axle or the rear axle.

Another implementation of the auto lock system for a manual treadmill comprises a locking mechanism having a disengaged position in which the locking mechanism is not engaged with the front axle or the rear axle, the front axle and the rear axle configured to move in both a forward direction and a rearward direction, and an engaged position in which the locking mechanism engages the front axle or the rear axle, inhibiting or preventing movement of the respective front axle or rear axle in both the forward direction and the rearward direction. An actuator is configured to move the locking mechanism between the disengaged position and the engaged position. A sensor is in communication with a controller and configured to detect a user on the tread. The controller is configured to, in response to the sensor detecting no user on the manual treadmill, actuate the actuator to move the locking mechanism from the disengaged position to the engaged position.

Another aspect of the disclosure is a system for a manual treadmill, the manual treadmill including a tread that rotates around a front axle and a rear axle and side rails on opposing sides of the tread, the system comprising a controller, a brake configured to slow a rotation speed of at least one of the front axle and the rear axle in response to a signal from the controller, a presence sensor configured to detect a user on the manual treadmill, and a locking mechanism configured to, when engaged, prevent rotation of at least one of the front axle and the rear axle when the presence sensor detects that the user is not on the manual treadmill.

The controller may be configured to engage the brake when the presence sensor detects that the user is not on the treadmill and engage the locking mechanism when the controller detects a speed of the tread at a threshold speed or lower.

The system may further comprise a slat-engaging mechanism configured to engage the tread to prevent movement of the tread when the locking mechanism is engaged. The tread may comprise slats, each slat having opposing ends attached to a respective belt. The slat-engaging mechanism may comprise a sprocket wheel with teeth, at least one tooth engaging a slat to prevent movement of the tread.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Described herein are devices, systems, and methods to improve the operation of both motorized and non-motorized treadmills. A locking system is described that may be configured to stop rotation of a treadmill tread after a user of the treadmill dismounts the treadmill. The locking system may prevent operation of the treadmill until the system determines that the next user is an authorized user. A braking system is described that may be configured to slow rotation of the tread when the user steps off of the tread. The braking system may allow free rotation of the tread when the system determines that the user has stepped back onto the tread. Treadmill lighting systems are also described. The lighting systems may alert individuals near the treadmill that the treadmill is operational. The lighting systems may also convey information to the user and observers of the user, including but not limited to the user's performance or biometric data.

Figure 1:
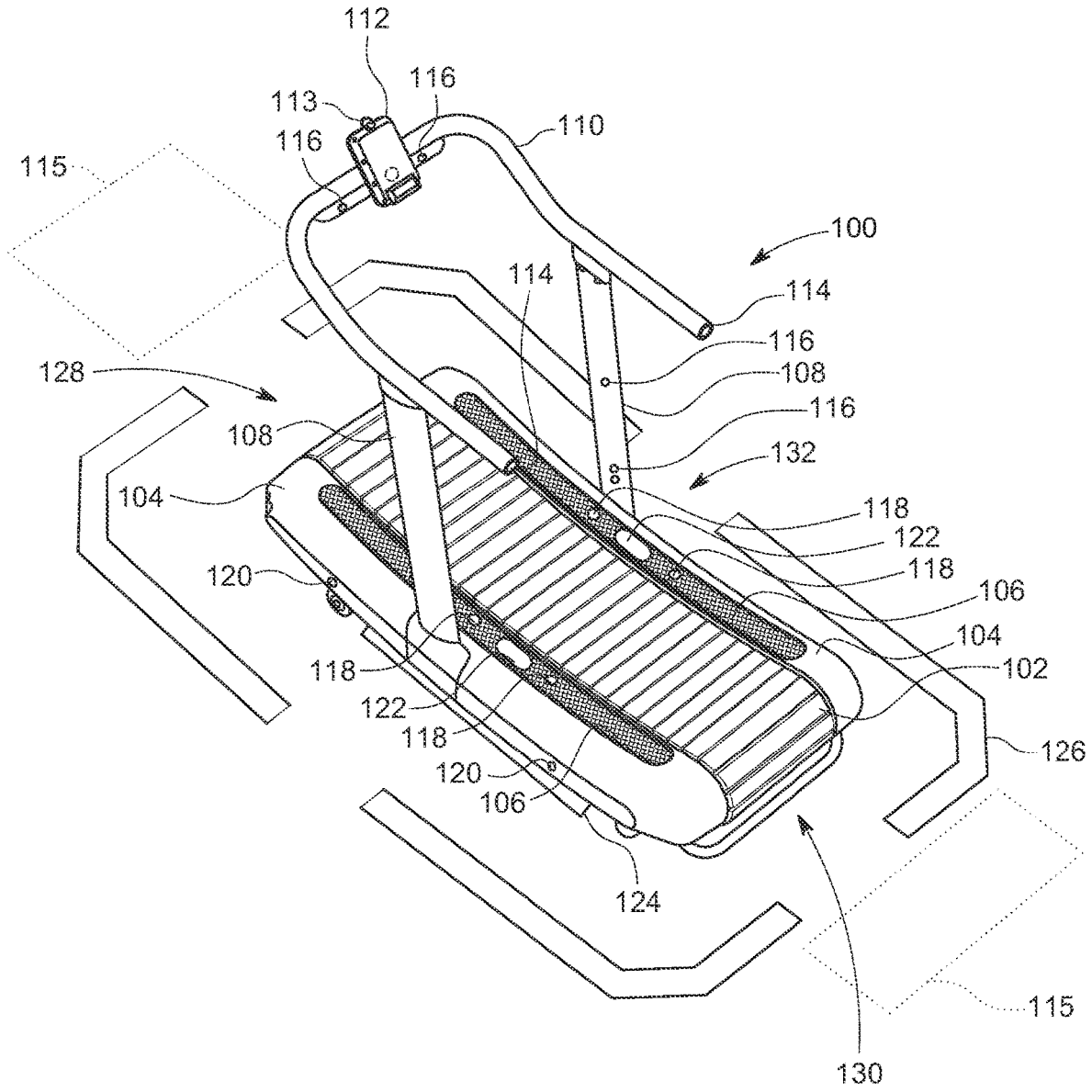
FIG. 1 is a top perspective view of a treadmill.

FIG. 1 is a top perspective view of a treadmill 100. The treadmill 100 may include a tread 102, side skirts 104, side rails 106, support members 108, a handrail 110, and a display 112. The treadmill 100 may also include one or more sensors, including but not limited to: infrared sensors, weight sensors, heartrate sensors, proximity sensors, cameras or any other user detection or biometric sensor. In the illustrated, non-limiting example shown in FIG. 1, the treadmill 100 includes presence sensors 116, weight sensors 118, and proximity sensors 120.

The tread 102 is a moving surface traversed by a user operating the treadmill 100 and may include a continuous or segmented belt. In the illustrated, non-limiting example shown in FIG. 1, the tread 102 includes multiple slats. Longitudinal ends of each slat may be attached to a respective belt that rotates on fixed bearings (e.g., free-turning roller bearings) around a front axle and a rear axle. The slats may be configured with a space between adjacent slats. In other embodiments, the tread 102 may include a continuous rubber belt. The tread 102 may be actuated by a motor (a motorized treadmill) or may be moved under the power of the user (a manual treadmill, also referred to a non-motorized treadmill). The tread 102 may be supported by an underlying frame (e.g., a rigid metal frame, not shown in FIG. 1) such that the tread 102 may include a flat, curved, inclined, or declined shape or orientation. The tread 102 may include any other shape or orientation.

One or more side skirts 104 may be supported by the underlying frame on opposing sides of the tread 102. Each side skirt 104 may include a side rail 106 located on an upper surface of the side skirt 104. The side rails 106 may be integral with the side skirts 104 or may be separately located on the side skirts 104. The side rail 106 provides a surface for the user to safely stand on the treadmill 100. For example, the user may stand on the side rails 106 to mount or dismount the tread 102 or to mount or dismount the treadmill 100 entirely while the tread 102 is moving or stationary. The side rails 106 may extend along any length and width of the side skirts 104. Each of the side rails 106 may include a foot pad 122 designating one or more portions of the side rails 106 on which the user may stand. The foot pads 122 may be integral with the side rails 106 or may be separately located on the side rails 106. The foot pads 122 may be illuminated by lights located on, above, around, and/or underneath the foot pads 122 to indicate a location for the user to stand on the side rails 106. For example, an outline of a foot may be illuminated from below the side rail 106 using opaque or transparent plastic material through which undermounted lights shine. The foot pads 122 may be illuminated by the lights in response to detection of the user by the proximity sensors 120, the presence sensors 116, or an input on the display 112.

The support members 108 may include struts or any other structural member. The support members 108 may be coupled at one end to the underlying frame and/or the side skirts 104 and at the other end to the handrail 110. The support members 108 provide structural support to the handrail 110 and may be coupled to any portion of the underlying frame and/or side skirts 104 (e.g., in the middle of the treadmill 100, at either end of the treadmill 100, or at any location there between). Any number of support members 108 can be used. The frame 202 may support other components of the treadmill 100 including but not limited to axles, the side skirts 104, the side rails 106, the support members 108, and/or the handrail 110. The frame 202 may be made of any metal or any other material and may include one or more structural members.

The handrail 110 is coupled to the support members 108 and provides the user support while the user is operating the treadmill 100. For example, the user may hold onto the handrail 110 to mount or dismount the tread 102 or to mount or dismount the treadmill 100 entirely. The handrail 110, alone or in combination with other support members, supports the display 112. The display 112 may include any screen (e.g., touchscreen) located on the handrail 110. The display 112 may include a non-contact skin temperature sensor 113 that may be configured to measure the temperature of the user while the user is present on the treadmill without the need for the sensor to contact the user. The display 112 may display information to the user including but not limited to: user heartrate, temperature, user calories burned, or any other biometric data; distance traveled, distance remaining, workout duration, workout time remaining, tread speed, user running pace, or any other user performance information; and/or data associated with another treadmill user.

The treadmill 100 may include one or more systems to improve functionality of the treadmill 100 and to enhance the user's experience. The treadmill 100 may include a lock system configured to prevent rotation of the tread 102 while the treadmill 100 is not in use and to stop rotation of the tread 102 in response to the user dismounting the treadmill 100. The treadmill 100 may additionally include a braking system configured to slow rotation of the tread 102 prior to engagement of the lock system. These systems may operate in response to signals received from the weight sensors 118 and the presence sensors 116, as non-limiting examples.

One or more weight sensors 118 may be positioned such that weight and/or presence is detected when a user stands on the foot pads 122 and/or the side rails 106. The weight sensors 118 may include strain gauges, load cells or any sensor configured to detect the weight and/or presence of the user. As used herein, "weight sensor" is any sensor that detects when a load is placed on it. To actually measure weight, two weight sensors, such as strain gauges, may be positioned under each foot pad 122 between the underlying frame with a bracket 200 shown in FIG. 2 physically connecting them. The bracket 200 may be positioned under the foot pads 122 and the tread 102 to evenly distribute the user's weight to the weight sensors 118 while standing on the foot pads 122.

Figure 2:
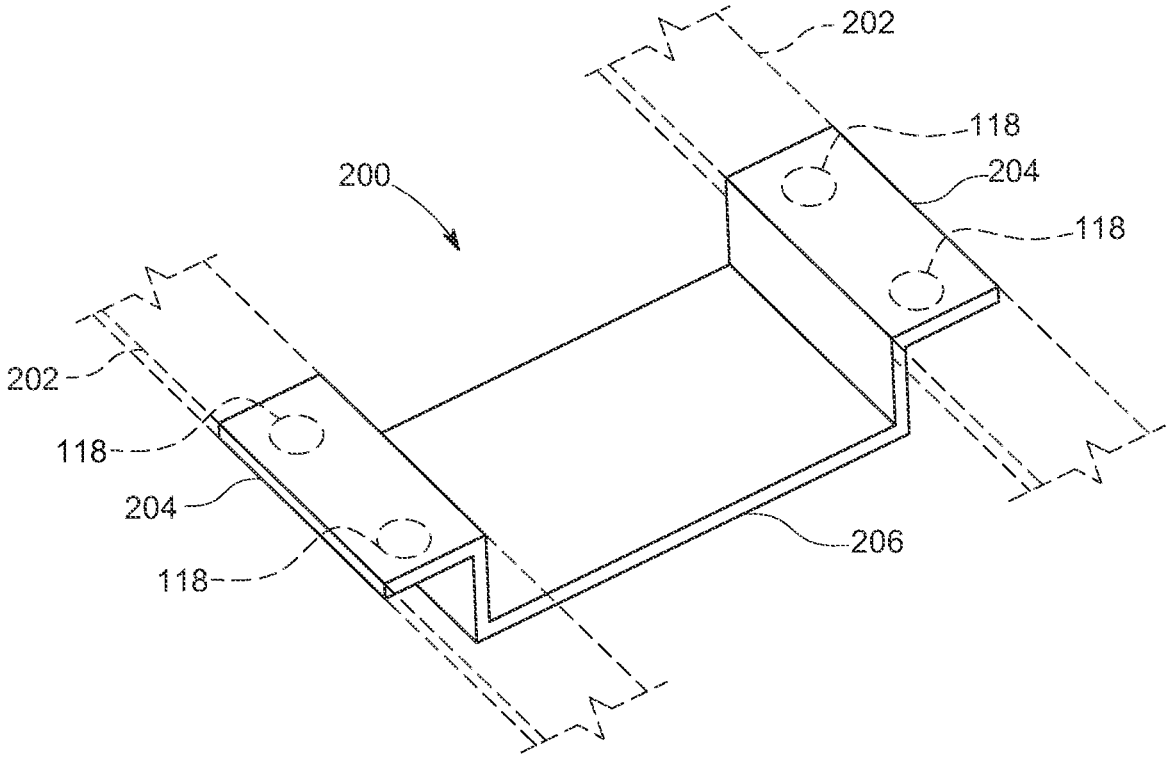
FIG. 2 is a top perspective view of a weight measurement or presence detection system of the treadmill.

In the illustrated, non-limiting example shown in FIG. 2, the bracket 200 has two opposing flanges 204 that overlay the strain gauges. A plate 206 extends between the flanges 204 to connect the flanges 204. In the illustrated, non-limiting example, the bracket 200 is U-shaped. The flanges 204 may be integral with the plate 206. For example, the bracket 200 may include a one-piece, pre-formed plastic or metal bracket. The bracket 200 can also include any configuration and/or orientation relative to the frame 202.

The weight sensors 118 may measure the weight of the user in response to the user stepping on the foot pads 122 overlying the bracket 200. In some embodiments, in response to a request by the user to measure the user's weight (e.g., using the display 112), the foot pads 122 may be illuminated by the lights to indicate to the user to stand on the foot pads 122. The user's weight may also be automatically measured in response to the weight sensors 118 detecting the user's presence on the foot pads 122. The user's weight may be displayed by the display 112.

Additionally and/or alternatively, the weight sensors 118 may detect the user's presence on the foot pads 122 and/or side rails 106. Additional weight sensors 118 may be positioned under the side rails 106 along a length of each side rail 106 for detecting presence. The treadmill 100 may be activated by a controller (later described with respect to FIG. 3) in response to the weight sensors 118 detecting the presence of the user on the foot pads 122 and/or the side rails 106. The treadmill 100 may also be deactivated by the controller in response to the weight sensors 118 detecting that no user is present on the foot pads 122 and/or the side rails 106.

One or more of the presence sensors 116 may be located on any portion of the support members 108, the handrail 110 or the display 112. The presence sensors 116 may include infrared sensors, ultrasonic sensors, LED linear light sensors, or any other sensor configured to detect a presence of the user on the treadmill 100 (e.g., standing between the support members 108, on the tread 102, the side rails 106, and/or the foot pads 122). The presence sensors 116 are positioned such that presence of a person near but not on the treadmill 100 will not be detected. The presence sensors 116 and the weight sensors 118 may operate alone or together to detect the presence of the user on any portion of the treadmill 100.

In one example, a user initiation system and method include weight sensors 118 under the foot pads 122 and side rails 106, presence sensors 116, and a lock 316 (later described with respect to FIG. 3). The user initiation method includes a user approaching a treadmill 100 with the intent to use the treadmill 100 that is not currently in use. If motorized, the power is off. In order to enable use of the treadmill 100, the user steps on the foot pads 122 or side rails 106 to activate the weight sensors 118, which detect the user's presence. Additionally, the presence sensors 116 detect that the user is on an area of the treadmill 100 in which desire to use may be inferred. The non-contact temperature sensor 113 can also function as a presence sensor 116, as the detection of a temperature equivalent to that of a person will indicate that a user is present in an area of the treadmill in which use could be initiated. The combination of presence detected by both the weight sensors 118 and the presence sensors 116 can initiate unlocking of the lock 316, which when in the locking position, prevents rotation of the tread 102 in any direction. Additionally, the user initiation system and method may require that the user input a code prior to unlocking the lock 316, as will be described in more detail below. The user initiation system and method prevent the tread 102 from moving if a person or animal is on the treadmill 100 for reasons other than use.

Figure 3:
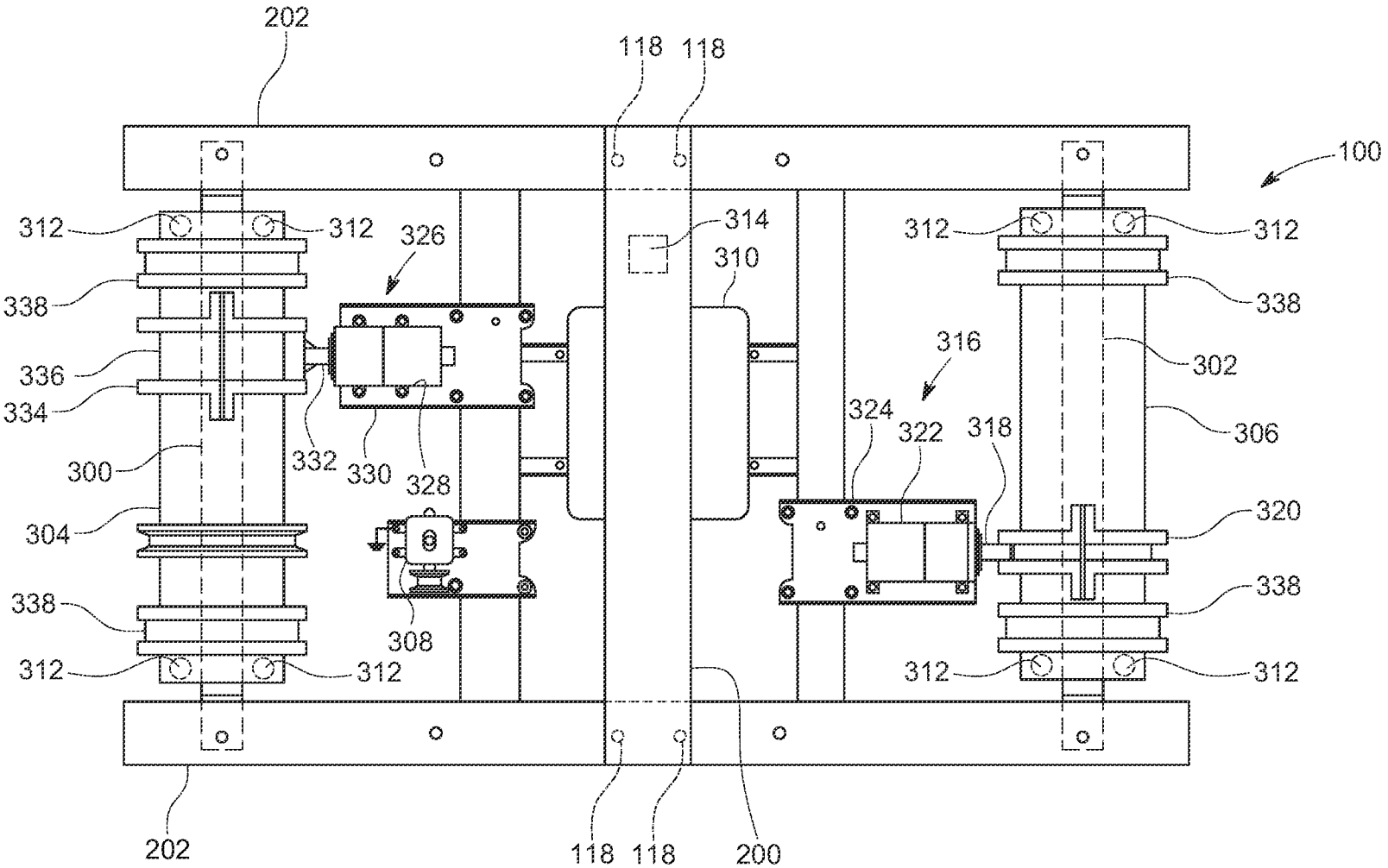
FIG. 3 is a diagram of internal components of the treadmill.

FIG. 3 is a diagram of internal components of the treadmill 100 including the lock and brake systems. In the illustrated, non-limiting example, the frame 202 includes two side members supporting the side skirts 104 and multiple cross-members extending between the side members.

The support members 108 are coupled to the side members of the frame 202. The bracket 200 extends between the two side members of the frame 202. Weight sensors 118 are positioned on side members of the frame 202 underneath the flanges 204 of the bracket 200. Additional weight sensors 118 are positioned on the side members of the frame 202 underneath the side skirts 104. The treadmill 100 may include any number of weight sensors.

The treadmill 100 may include a front axle 300 and a rear axle 302. The front axle 300 and the rear axle 302 may be coupled to the frame 202 and may rotate relative to the frame 202 via bearings 312. The bearings 312 may allow two-way or one-way rotation of the front axle 300 and the rear axle 302. One-way rotation allows the tread 102 to rotate in only one direction and prohibits the tread 102 from moving "backwards" in the opposite direction.

The front axle 300 and the rear axle 302 may include a front axle drum 304 and a rear axle drum 306 respectively. The front axle drum 304 and the rear axle drum 306 may surround the front axle 300 and the rear axle 302 respectively such that the front axle drum 304 and the rear axle drum 306 rotate while the front axle 300 and the rear axle 302 are fixed. The front axle drum 304 and the rear axle drum 306 may enlarge the diameter of the front axle 300 and the rear axle 302 respectively. The tread 102 may extend around the front axle drum 304 and the rear axle drum 306 such that rotation of the front axle drum 304 and/or the rear axle drum 306 results in rotation of the tread 102. In embodiments where the treadmill 100 is motorized, an electric motor (not shown) can be coupled to and may rotate the front axle 300, the rear axle 302, the front axle drum 304, and/or the rear axle drum 306 when activated. The electric motor may be coupled to the front axle 300, rear axle 302, front axle drum 304, or rear axle drum 306 via a belt or any other known means. For example, a belt may be attached to the tread on either side of the tread, the belt rotated around wheels 338 that are turned by the axles/drums. The electric motor may be directly coupled to the frame 202 or may be coupled to the frame 202 via a bracket or any other intermediate component. As used herein, reference to "axle" means the rotating element, whether the actual front and rear axles 300, 302 or the front and rear axle drums 304, 306.

In embodiments where the treadmill 100 is non-motorized, the treadmill 100 may include an electric generator 308. The electric generator 308 may convert rotation of the front axle 300, the rear axle 302, the front axle drum 304, and/or the rear axle drum 306 to electrical energy stored in the battery 310. The electric generator 308 may include a dynamo generator, a magneto motor, or any other device configured to convert rotation of the axles or axle drums to energy used to power the battery 310. The electric generator 308 may be coupled to the front axle 300, the rear axle 302, the front axle drum 304, or the rear axle drum 306 via a belt or any other known means. The electric generator 308 may be directly coupled to the frame 202 or may be coupled to the frame 202 via a bracket or any other intermediate component.

The battery 310 may include a 12/24 VDC battery but may include one or more batteries of any type, operating at any voltage. The battery 310 may be directly coupled to the frame 202 or may be coupled to the frame 202 via a bracket or any other intermediate component. In other embodiments, the battery 310 may not be coupled to the frame 202. The battery 310 may be external to the treadmill 100 (e.g., the battery 310 may be located adjacent to the treadmill 100 or beneath the treadmill 100 in a space defined by the treadmill 100). The battery 310 may include a charging port to receive power from an external power source. The charging port may be used if the charge of the battery 310 is depleted. The battery 310 may power any electrical component described herein, including but not limited to any lights, sensors, displays, or controllers. Additionally and/or alternatively, the treadmill 100 may include a motor with a power cord configured to electrically connect to an external power source (e.g., a power socket). A single motor may be used to power the described electrical components.

The treadmill 100 may include a controller 314. The controller 314 may receive data from the presence sensors 116, the weight sensors 118, the proximity sensors 120, and/or any other sensors. The controller 314 may also be in electrical communication with any other described electrical component, including but not limited to the display 112, the electric generator 308, and the battery 310. The controller 314 may be coupled to any portion of the frame 202 but may be coupled to any portion of the treadmill 100. The controller 314 may be coupled to the frame 202 via a bracket or any other intermediate component or may be directly coupled to the frame 202 or to a surface of the battery 310 (e.g., a top surface of the battery 310).

The lock 316 is configured to automatically stop rotation of the tread 102 in any direction when the user is not present on the treadmill 100 (e.g., not present on the tread 102 or the side rails 106). Once the lock 316 is engaged, such as when the user steps off of the treadmill, the lock 316 may prevent rotation of the tread 102 in any direction until the user is again identified by presence with the one or more of weight sensors, infrared sensors and the entry of an identification code.

The lock 316 may include a locking member 318, a locking member receiver 320, an actuator 322, and an actuator bracket 324. In the illustrated, non-limiting example shown in FIG. 3, the locking member receiver 320 is coupled to the rear axle drum 306 and rotates with the rear axle drum 306. The locking member receiver 320 may be coupled to the rear axle drum 306 using keys, screws, nuts, bolts, rivets, welding, or any other means of attachment. In other embodiments, the locking member receiver 320 may be coupled to the front axle 300, the front axle drum 304, or the rear axle 302. The locking member receiver 320 is configured to receive the locking member 318. The locking member receiver 320 may include a cam or any other device capable of engaging with the locking member 318 to prohibit rotation of the front axle 300, rear axle 302, front axle drum 304, and/or the rear axle drum 306 in any direction.

The actuator 322 is configured to move the locking member 318 between a locked position and an unlocked position. The actuator 322 may include any type of spring, motor, solenoid, electric cylinder having an integrated motor, or any other device capable of moving the locking member 318 to engage the locking member receiver 320. The actuator 322 is coupled to the actuator bracket 324 using any described means of attachment. The actuator bracket 324 is coupled to the frame 202 using any described means of attachment. In other embodiments, the actuator 322 may be directly coupled to any portion of the frame 202.

The actuator 322 is configured to move the locking member 318 to engage the locking member receiver 320. The locking member 318 can include any bolt, rod, plate, piston, or any other device configured to engage the locking member receiver 320 to prohibit rotation of the front axle 300, rear axle 302, front axle drum 304, and/or the rear axle drum 306 in any direction.

To move the locking member 318 into the locked position, the actuator 322 moves the locking member 318 towards the locking member receiver 320 until the locking member 318 engages the locking member receiver 320. In the locked position, contact between the locking member 318 and the locking member receiver 320 prohibits the locking member receiver 320 and the rear axle drum 306 from rotating in any direction. Stopping rotation of the rear axle drum 306 results in stopping rotation of the tread 102. In the unlocked position, the locking member 318 does not contact the locking member receiver 320 and the locking member receiver 320 and the rear axle drum 306 is allowed to rotate freely. Multiple locks 316 may be used to stop rotation of the front axle 300, the rear axle 302, the front axle drum 304, or the rear axle drum 306. The lock 316 may be used in embodiments where the treadmill 100 is motorized or non-motorized.

Figure 4:
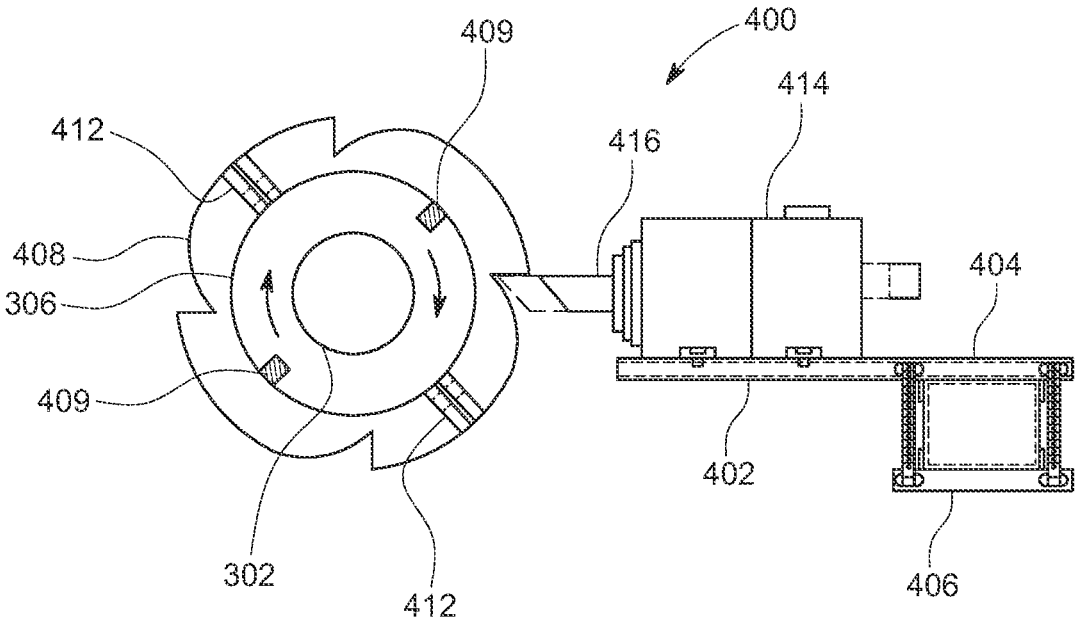
FIG. 4 is a side view of an embodiment of a lock.

FIG. 4 is a side view of an embodiment of a lock 400 that can be used as lock 316 and may include features similar to those of the lock 316 except as otherwise described. An actuator bracket 402 includes a first plate 404 and a second plate 406. The first plate 404 can be disposed on one side of any portion of the frame 202 and the second plate 406 can be disposed on an opposing side of the portion of the frame 202. The first plate 404 and the second plate 406 are coupled using nuts and screws, but any other described means of attachment can be used. The actuator bracket 402 is not limited to the structure shown in FIG. 4 but may include any intermediate component of any shape and size coupling an actuator to the frame 202.

The lock 400 includes a toothed cam 408 coupled to the rear axle drum 306 such that the toothed cam 408 rotates with the rear axle drum 306. The toothed cam 408 is coupled to the rear axle drum 306 using keys 409. The toothed cam 408 may include two halves that are coupled via flanges 412 and fasteners such as nuts and bolts. The toothed cam 408 may include sidewalls on opposing sides of the toothed cam 408. The toothed cam 408 is shown having four teeth but may include any number of teeth. The teeth of the toothed cam 408 may have any shape. In other embodiments, any type of cam having any shape may be used. The lock 400 includes a solenoid 414 (e.g., a bi-state solenoid) coupled to the first plate 404 of the actuator bracket 402 using screws, bolts, or any other described means of attachment. The solenoid 414 may include features similar to those of the actuator 322 except as otherwise described. In other embodiments, any other actuator may be used. The lock 400 includes a bolt 416 coupled to the solenoid 414. The bolt 416 may include features similar to those of the locking member 318 except as otherwise described.

The solenoid 414 is configured to move the bolt 416 between locked and unlocked positions. To move the bolt 416 into the locked position (shown in broken lines), the solenoid 414 moves the bolt 416 towards the toothed cam 408 until the bolt 416 engages a tooth of the toothed cam 408. Engagement between the bolt 416 and the tooth of the toothed cam 408 stops the toothed cam 408 from rotating in any direction. Stopping rotation of the toothed cam 408 stops rotation of the rear axle drum 306, which stops rotation of the tread 102. To move the bolt 416 into the unlocked position, the solenoid 414 is configured to move the bolt away from the toothed cam 408 until the bolt 416 does not contact the toothed cam 408, allowing the toothed cam 408 to rotate freely. In embodiments where the solenoid 414 is a bi-state solenoid, once the solenoid 414 is energized by the battery 310 to move the bolt 416 to the locked position, the bolt 416 remains in the locked position until the solenoid 414 is energized again. In such embodiments, the bolt 416 may remain in the locked position even if no power is supplied to the solenoid 414 or any other component of the treadmill 100. Similarly, once the solenoid 414 is energized by the battery 310 to move the bolt 416 to the unlocked position, the bolt 416 remains in the unlocked position until the solenoid 414 is energized again.

The lock 316 (or lock 400) may be in electrical communication with the controller 314 and may operate in conjunction with the weight sensors 118 and the presence sensors 116 as a user-initiated system and method as follows. When not in use, the treadmill 100 will be locked, i.e., the lock 316 will be in the locked position. For example, if, during operation of the treadmill 100, the controller 314 determines that the user is not present on the tread 102 and not present on the side rails 106, the controller 314 is configured to engage the lock 316 as previously described to prevent movement of the tread 102 in any direction. Engagement of the lock 316 may be instant, i.e., as soon as the sensors 118, 116 both fail to detect a user. Engagement of the lock 316 may occur after a period of time. In embodiments where the treadmill 100 is motorized, the controller 314 may disconnect (e.g., electrically disconnect) power to the electric motor (not shown) before engaging the lock 316. In embodiments where the treadmill 100 is non-motorized, the battery powers the actuator to engage the lock 316. Prior to or in response to engaging the lock 316, the display 112 may generate a notification indicating to the user that the lock 316 will be engaged and/or is engaged.

Once the controller 314 has engaged the lock 316, the lock 316 remains engaged until the controller 314 determines that one or more initiation criteria have been met. The initiation criteria may include one or more in combination: detection of the user's presence on the foot pads 122 by the weight sensors 118; detection of the user's presence on both side rails 106 by the weight sensors 118; detection of the user's presence on any portion of the side rail 106 by the weight sensors 118; detection of the user by the presence sensors 116; a determination by the controller 314 that a user weight detected by the weight sensors 118 meets or exceeds a threshold weight; and/or authorization of an identification code entered by the user (e.g., using the display 112).

In embodiments where the initiation criteria includes authorization of the identification code, the controller 314 may verify the identification code by comparing the identification code to a list of authorized codes stored locally on the treadmill 100 (e.g., in memory included in the controller 314) or remotely on a server device in communication with the treadmill 100 (e.g., in communication with the controller 314) in response to receiving the user's identification code. The controller 314 may disengage the lock 316 in response to determining that the identification code entered by the user matches one of the authorized codes. The identification code prevents unauthorized users from using the treadmill 100. In some embodiments, no identification code is required. Additionally and/or alternatively, the treadmill 100 may verify the identity of the user using biometric information detected by any sensors located on the treadmill 100 (e.g., fingerprint data, voice data, or facial recognition data).

Figure 5A:
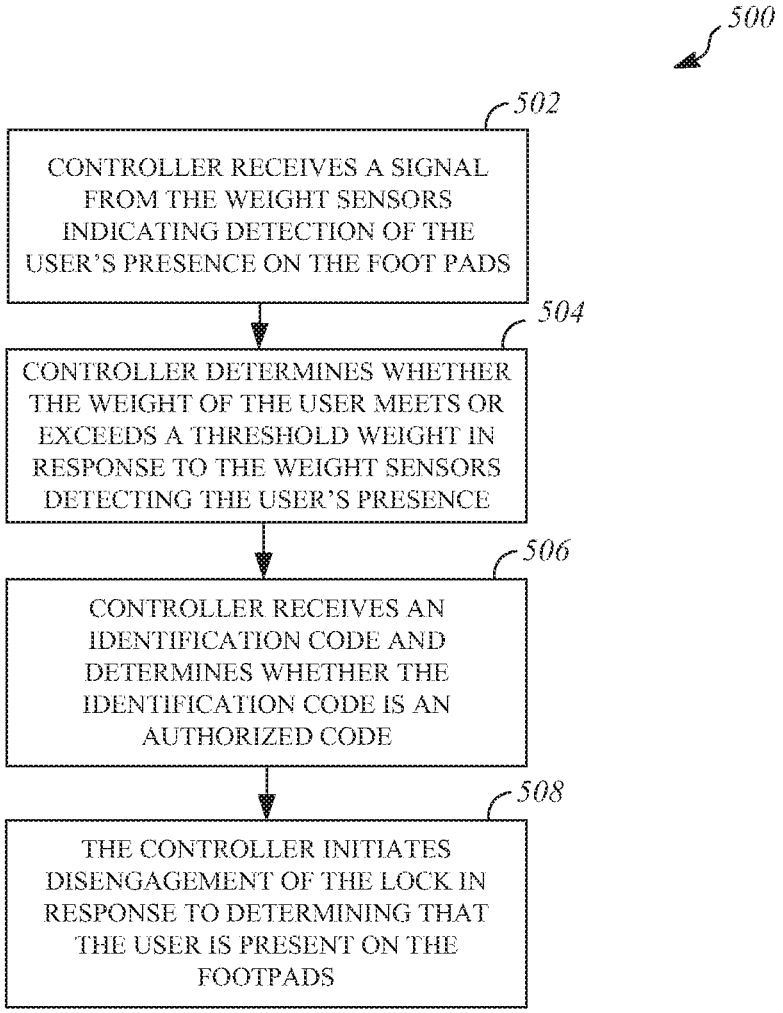
FIG. 5A is a flow diagram of an embodiment of a user-initiation system and process.

FIG. 5A is a flow diagram of an embodiment of the user-initiation system and process 500, initiating use of the treadmill 100 where the lock 316 is in the engaged position. It is contemplated that either or both of a weight sensor or presence sensor may detect a user on the treadmill and turn on the display. The display may direct the user to stand on the foot pads 122 to unlock the tread. In operation 502, the controller 314 receives a signal from the weight sensors 118 indicating detection of the user's presence the foot pads 122. In operation 504, the controller 314 determines whether the weight of the user meets or exceeds a threshold weight in response to the weight sensors 118 detecting the user's presence. The threshold weight can be preprogrammed into the controller or can be set by the owner or operator. As one example, the weight threshold reduces the chance that a child who should not be using the treadmill is able to unlock the treadmill. In optional operation 506, the controller 314 receives an identification code and determines whether the identification code is an authorized code. It is contemplated that the display may present a prompt for the user to input his or her identification code prior to or once the user is standing on the foot pads 122.

In operation 508, the controller 314 initiates disengagement of the lock 316 in response to determining that the user is present on the foot pads 122 and equals or exceeds the threshold weight and optionally inputted the proper identification code, leaving the user free to use the treadmill 100. The disengagement is powered by the battery for a non-motorized treadmill and is powered by the motor for a motorized treadmill. For example, referring to the lock 400 shown in FIG. 4, the controller 314 may initiate the solenoid 414 to move the bolt 416 away from the toothed cam 408 into the locked position. In operation 508, the controller 314 may also initiate activation of any other electronic components of the treadmill 100, including but not limited to any displays, lights, motors, or controllers. The initiation system will not be needed again until the lock is in its locked position.

Figure 5B:
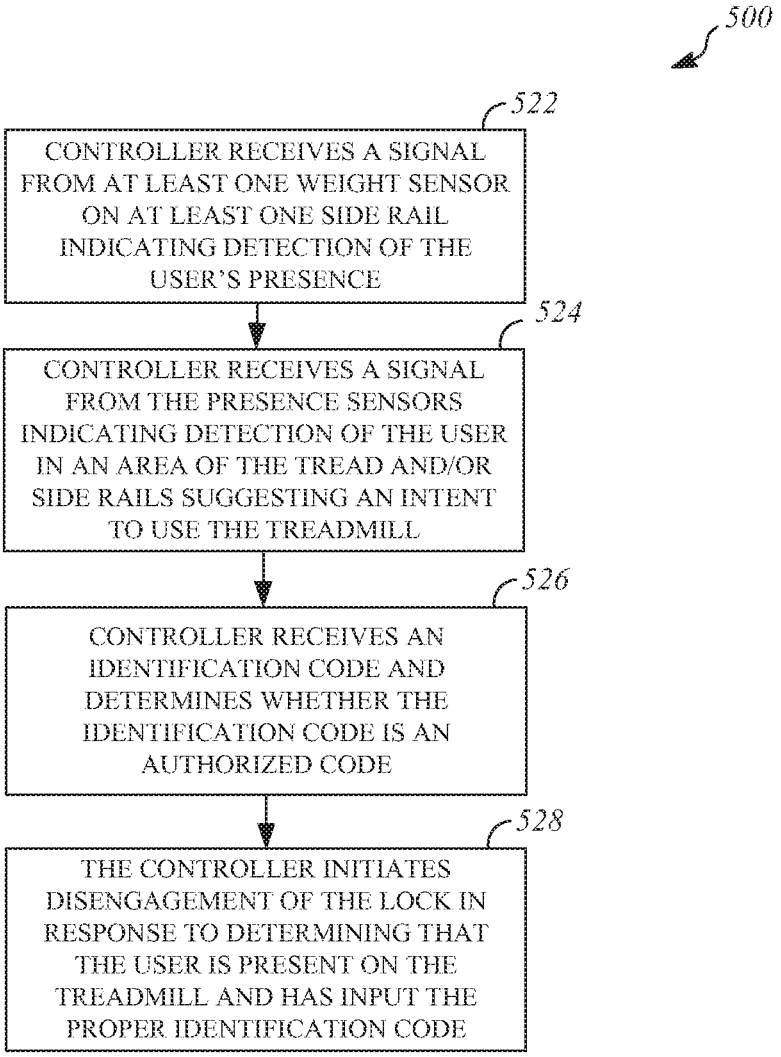
FIG. 5B is a flow diagram of another embodiment of the user-initiation system and process.

FIG. 5B is a flow diagram of another embodiment of the user-initiation system and process 520, initiating use of the treadmill 100 where the lock 316 is in the engaged position. It is contemplated that either or both of a weight sensor or presence sensor may detect a user on the treadmill and turn on the display. The display may direct the user to stand on the side rails for safety. In operation 522, the controller 314 receives a signal from at least one weight sensor 118 on at least one side rail indicating detection of the user's presence. Alternatively, the system may require that the controller 314 receives a signal from at least one weight sensor 118 on each side rail indicating presence of the user, i.e., the user is straddling the tread. In operation 524, the controller 314 receives a signal from the presence sensors 116 indicating detection of the user in an area of the tread and/or side rails suggesting an intent to use the treadmill. In operation 526, the controller 314 receives an identification code and determines whether the identification code is an authorized code. It is contemplated that the display may present a prompt for the user to input his or her identification code prior to or once the user is standing on the foot pads 122.

In operation 528, the controller 314 initiates disengagement of the lock 316 in response to determining that the user is present on the treadmill and has input the proper identification code, leaving the user free to use the treadmill 100.

Figure 6:
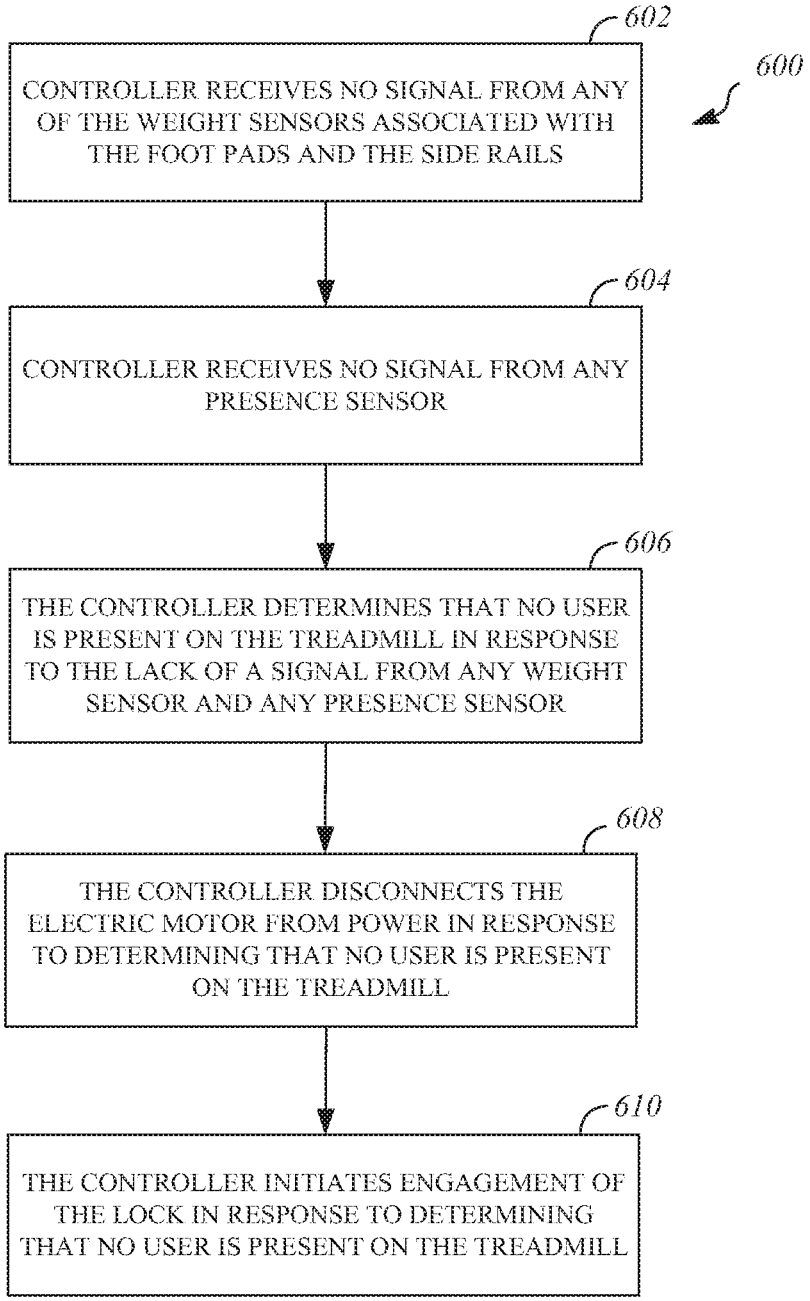
FIG. 6 is a flow diagram of a process of engaging a lock when the lock has been disengaged and the treadmill has been in use.

FIG. 6 is a flow diagram of a process 600 of engaging the lock 316 when the lock has been disengaged and the treadmill has been in use. In operation 602, the controller 314 receives no signal from any of the weight sensors 118 associated with the foot pads 122 and the side rails 106. In operation 604, the controller 314 receives no signal from any presence sensor 116. In operation 606, the controller 314 determines that no user is present on the treadmill 100 in response to the lack of a signal from any weight sensor 118 and any presence sensor 116.

In embodiments where the treadmill 100 is a motorized treadmill, the process 600 may include operation 608. In operation 608, the controller 314 disconnects the electric motor from power in response to determining that no user is present on the treadmill 100. The controller 314 may initiate engagement of the lock 316 in response to determining that no user is present on the treadmill 100 and in response to disconnecting the power to the electric motor. In embodiments where the treadmill 100 is a non-motorized treadmill, the process 600 proceeds from operation 606 to operation 610. In operation 610, the controller 314 initiates engagement of the lock 316 in response to determining that no user is present on the treadmill 100. The controller 314 may initiate engagement of the lock 316 after a threshold period has expired. In one example, the controller 314 may initiate engagement of the lock 316 in response to determining that no user is present on the treadmill 100 and to determining that the threshold period has expired. The threshold period begins in response to determining that no user is present on the treadmill 100. The threshold period of time can vary and can be set by the user of the treadmill or can be predetermined. The lock 316 remains engaged until the initiation process previously described is completed. The controller 314 may deactivate the display 112 and/or other electronic components of the treadmill 100 in response to determining that no user is present on the tread 102 and that no user is present on the side rails 106.

Referring back to FIG. 3, the treadmill 100 may include a brake 326. The brake 326 is configured to slow rotation of the tread 102 in response to the user stepping off of the tread 102 and onto the side rails 106 (e.g., while the user is resting). By slowing but not completely stopping rotation of the tread 102 while the user is resting on the side rails 106, the user may step back onto the tread 102 and continue using the treadmill more easily. Additionally and/or alternatively, the brake 326 may stop rotation of the tread 102 over a period of time if the user is standing on the side rails 106 for an extended period of time.

During use of the treadmill 100, a user may step on the side rails 106 and off of the tread 102 to take a drink, answer a phone call, talk to someone present, or rest, as non-limiting examples. When the user steps on the side rails 106 while the tread 102 is moving, the brake 326 engages to slow the tread 102 down so that when the user is ready to step back on the tread 102, the tread 102 moves at a slower, more manageable pace than when the user stepped off. If the treadmill 100 is a motorized treadmill, the power to the electric motor will be temporarily disconnected while the brake 326 is applied. The brake 326 may be applied until the user steps back on the tread 102, i.e., no weight sensor 118 on the side rails 106 detects the user's weight. The user will then bring the tread 102 up to the desired rotational speed, either under the user's own power (if the treadmill 100 is non-motorized) or by using a tread speed control on the display 112 (if the treadmill 100 is motorized). If the user remains off the tread 102 and on the foot pads 122 for a period of time, the brake 326 may be disengaged when a threshold time or speed is reached, allowing the tread 102 to further slow under its own momentum. Alternatively, the brake 326 can be applied until the earlier of the tread 102 is stopped or the user steps back on the tread 102.

The brake 326 may include a brake actuator 328, a brake actuator bracket 330, a braking member 332, and a braking member receiver 334. In the illustrated, non-limiting example, the braking member receiver 334 is coupled to and rotates with the front axle drum 304. The braking member receiver 334 includes a channel 336 having an interior profile corresponding to the exterior profile of the braking member 332. The braking member receiver 334 may be coupled to the front axle drum 304 using keys, screws, nuts, bolts, rivets, welding, or any other means of attachment. In other embodiments, the braking member receiver 334 may be coupled to the front axle 300, the rear axle 302, or the rear axle drum 306. The braking member receiver 334 is configured to receive the braking member 332. The braking member receiver 334 may include a circular coupling or any other device configured to receive the braking member 332 to slow rotation of the front axle 300, rear axle 302, front axle drum 304, and/or the rear axle drum 306. Multiple brakes 326 may be used to slow rotation of the front axle 300, the rear axle 302, or the rear axle drum 306. The brake 326 may be used in embodiments where the treadmill 100 is motorized or non-motorized.

The brake actuator 328 is configured to move the braking member 332 between a braking position and a non-braking position. The brake actuator 328 may include any type of spring, motor, solenoid, electric cylinder having an integrated motor, or any other device capable of moving the braking member 332 to engage the braking member receiver 334. The brake actuator 328 is coupled to the brake actuator bracket 330 using any described means of attachment. The brake actuator bracket is coupled to the frame 202 using any described means of attachment. In other embodiments, the brake actuator 328 may be directly coupled to any portion of the frame 202.

The brake actuator 328 is configured to move the braking member 332 to engage the braking member receiver 334. The braking member 332 can include a brake pad, caliper, or any other device configured to engage the braking member receiver 334 to slow rotation of the front axle 300, rear axle 302, front axle drum 304, and/or the rear axle drum 306.

To move the braking member 332 into the braking position, the brake actuator 328 moves the braking member 332 towards the braking member receiver 334 until the braking member 332 engages the braking member receiver 334. In the braking position, friction between the braking member 332 and the braking member receiver 334 reduces the rotational speed of the front axle drum 304. In the non-braking position, the braking member 332 does not engage the braking member receiver 334 and the front axle drum 304 is allowed to rotate freely. A reduction in rotational speed of the front axle drum 304 results in a reduction in rotational speed of the tread 102. In some embodiments, the braking member receiver 334 is not required and the braking member 332 directly engages the front axle 300, the rear axle 302, the front axle drum 304, and/or the rear axle drum 306.

Figure 7:
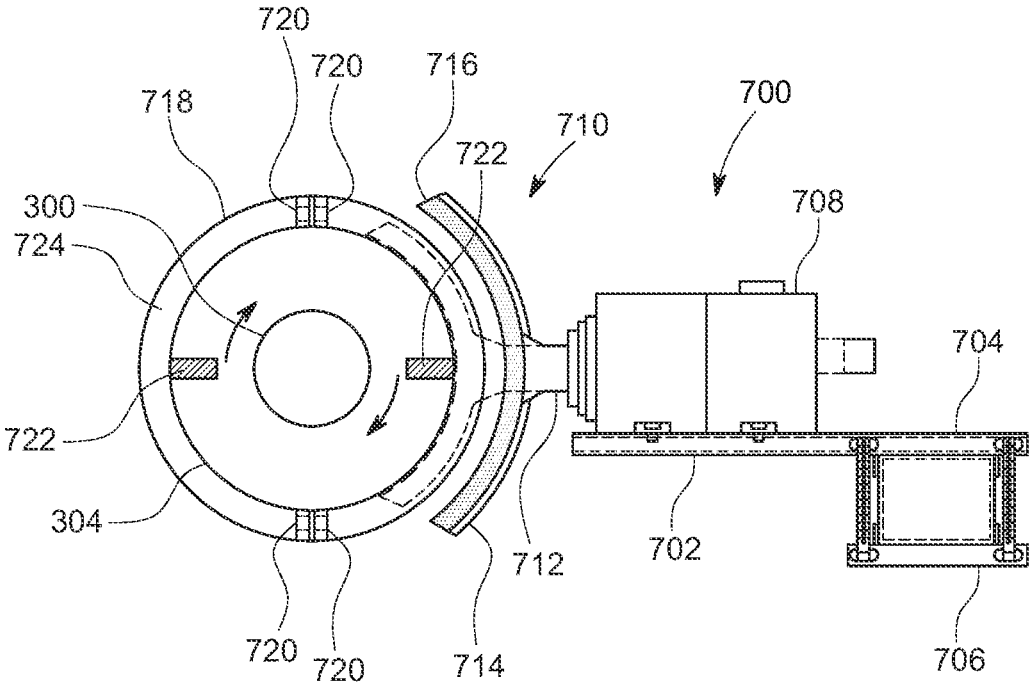
FIG. 7 is a side view of an embodiment of a brake.

FIG. 7 is a side view of an embodiment of a brake 700 that can be used as brake 326 and may include features similar to those of brake 326 except as otherwise described. In the illustrated, non-limiting example, the brake 700 includes a brake actuator bracket 702 including a first plate 704 and a second plate 706. The first plate 704 can be disposed on one side of any portion of the frame 202 and the second plate 706 can be disposed on an opposing side of the portion of the frame 202. The first plate 704 and the second plate 706 are coupled using nuts and screws, but any other described means of attachment can be used. The brake actuator bracket 702 is not limited to the structure shown in FIG. 7 but may include any intermediate component of any shape and size coupling a brake actuator to the frame 202.

The brake 700 includes a solenoid 708 (e.g., a bi-state solenoid) coupled to the first plate 704 of the brake actuator bracket 702 using screws, bolts, or any other described means of attachment. The solenoid 708 is an example of the brake actuator 328 except as otherwise described. The brake 700 includes braking member 710 having a bolt 712, a brake pad retainer 714, and a brake pad 716. The braking member 710 may include features similar to those of the braking member 332 except as otherwise described. The bolt 712 is coupled to a brake pad retainer 714. The brake pad retainer 714 may be integral with the bolt 712 or coupled separately to the bolt 712. The brake pad retainer 714 includes a curved shape. A brake pad 716 having a curved shape is coupled to the brake pad retainer 714. The brake pad 716 may be made of ceramic or any other suitable material. In other embodiments, the brake 700 may not include the braking member 710 but may include any device configured to engage a braking member receiver.

The brake 700 includes a circular coupling 718 extending around the front axle 300 or front axle drum 304 shown). The circular coupling 718 may include features similar to those of the braking member receiver 334 unless otherwise described. The circular coupling 718 may include two halves that are coupled via flanges 720 and fasteners such as nuts and bolts. The circular coupling 718 is coupled to the front axle drum 304 using keys 722. The circular coupling 718 defines a channel 724 having an interior profile shaped to correspond to an exterior profile of the brake pad 716. In other embodiments, the brake 700 may not include the circular coupling 718 but may include any device configured to receive a braking member (e.g., the bolt 712) to slow an axle or axle drum of the treadmill 100.

The solenoid 708 is powered by the battery 310 or a motor for a non-motorized treadmill and moves the braking member 710 between the braking and non-braking positions. In the braking position, the brake pad 716 contacts an interior surface of the channel 724 and friction between the brake pad 716 and the circular coupling 718 slows rotation of the front axle drum 304. In the non-braking position of the braking member 710, the brake pad 716 does not contact the circular coupling 718 and the front axle drum 304 is allowed to rotate freely. In embodiments where the solenoid 708 is a bi-state solenoid, once the solenoid 708 is energized by the battery 310 to move the braking member 710 to the braking position, the braking member 710 remains in the braking position until the solenoid 708 is energized again. Similarly, once the solenoid 708 is energized by the battery 310 to move the braking member 710 to the non-braking position, the braking member 710 remains in the braking position until the solenoid 708 is energized again.

The brake actuator 328 may be in electrical communication with the controller 314 and may operate in conjunction with the weight sensors 118 and the presence sensors 116 as follows. The presence sensors 116 located on the support members 108 and/or the handrail 110 are configured to detect the presence of the user on the treadmill 100 (e.g., the user is standing on any portion of the tread 102 or side rails 106). The weight sensors 118 located underneath the side rails 106 are configured to detect whether the user is present on any portion of the side rails 106 and/or foot pads 122. In response to the controller 314 determining that the user is present on the tread 102 and that the user is not present on either of the side rails 106, the brake 326 remains disengaged, allowing the tread 102 to rotate freely.

If, during operation of the treadmill 100, the controller 314 determines that the user is present on both the side rails 106 (e.g., simultaneously) and that the user is not present on the tread 102 (e.g., the user has stepped off the tread 102 onto one or both of the side rails 106) the controller 314 may engage the brake 326 to slow rotation of the tread 102 as previously described. Optionally, the controller 314 may be configured to apply the brake 326 only when the user is standing on both foot pads 122, indicating a desire for the brake to be applied. The display may indicate to the user during use that stepping on the foot pads 122 will apply the brake during a rest period. In response to engaging the brake 326, the display 112 may generate a notification indicating to the user that the brake 326 is engaged. The brake 326 may slow rotation of the tread 102 to threshold speed which may be predetermined or may be set by the user. In response to the controller 314 determining that the tread 102 is rotating at the threshold speed, the controller 314 may fully or partially disengage the brake. After the brake 326 has been engaged, and in response to the controller 314 determining that the user is present on the tread 102 and not present on the side rails 106 (e.g., the user has stepped off of the side rails 106 back onto the tread 102), the controller may disengage the brake 326, allowing the tread 102 to rotate freely. In embodiments where the treadmill 100 is motorized, the controller 314 may disconnect (e.g., electrically disconnect) power to the electric motor before engaging the brake 326 and reconnect power when the brake 326 is disengaged.

Figure 8:
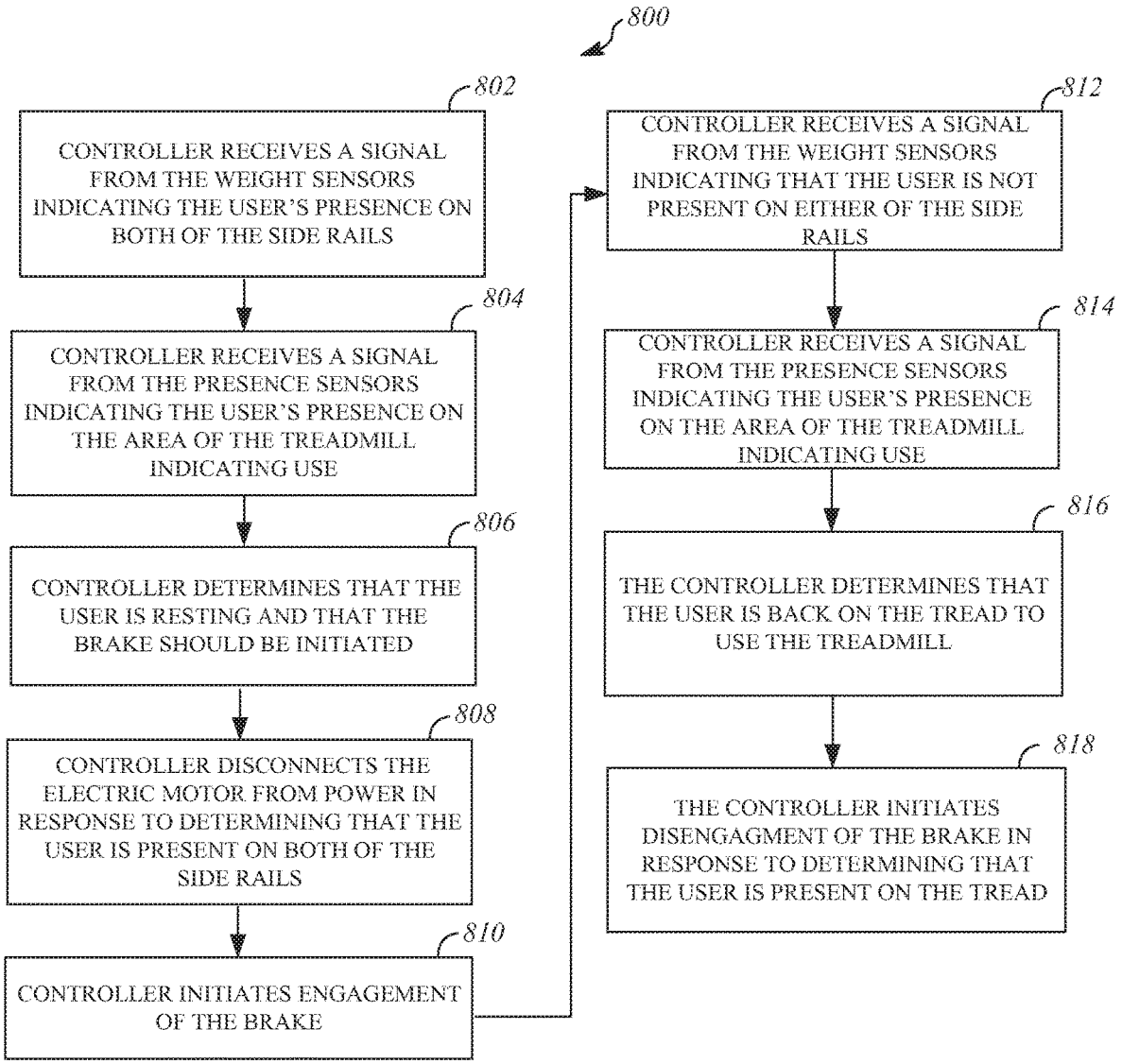
FIG. 8 is a flow diagram of a process of operating a brake while a tread of the treadmill is moving.

FIG. 8 is a flow diagram of a process 800 of operating the brake 326 while the tread 102 is moving. At operation 802, the controller 314 receives a signal from the weight sensors 118 indicating the user's presence on both of the side rails 106, e.g., the user is straddling the tread 102. At operation 804, the controller 314 receives a signal from the presence sensors 116 indicating the user's presence in the area of the treadmill 100 indicating use. At operation 806, the controller 314 determines that the user is "resting" and that the brake 326 should be initiated. In embodiments where the treadmill 100 is a motorized treadmill, the process 800 may include operation 808. In operation 808, the controller 314 disconnects the electric motor from power in response to determining that the user is present on both of the side rails 106. In embodiments where the treadmill 100 is a non-motorized treadmill, the process 800 proceeds from operation 806 to operation 810.

At operation 810, the controller 314 initiates engagement of the brake 326. For example, referring to the brake 700 shown in FIG. 7, the controller 314 can initiate the braking member 710 to move such that the brake pad 716 contacts the circular coupling 718. In some embodiments, the controller 314 may initiate engagement of the brake 326 in response to determining the user is present on any portion of each side rail. In other embodiments, the controller 314 may initiate engagement of the brake 326 in response to the user being present on the foot pads 122. Additionally and/or alternatively, the controller 314 may initiate engagement of the brake 326 in response to the tread 102 reaching a maximum speed. The maximum speed may be set by the user or may be predetermined.

At operation 812, the controller 314 receives a signal from the weight sensors 118 indicating that the user is not present on either of the side rails 106 (e.g., the controller detects that no signal is received from any weight sensor 118 on either side rail 106). At operation 814, the controller receives a signal (i.e., continues to receive the signal of presence of the user) from the presence sensors indicating the user's presence on the area of the treadmill 100 indicating use. At operation 816, the controller determines the user is back on the tread 102 to use the treadmill 100. At operation 818, the controller 314 initiates disengagement of the brake 326 in response to determining that the user is present on the tread 102. For example, referring to the brake 700 shown in FIG. 7, the controller 314 can initiate the braking member 710 to move such that the brake pad 716 does not contact the circular coupling 718.

The treadmill 100 may include lights and lighting systems configured to provide information to the user and/or to others (e.g., warn others in the vicinity that the treadmill 100 is operational).

Referring back to FIG. 1, one or more of the proximity sensors 120 may be located on one or more of the side skirts 104. For example, one or more proximity sensors 120 can be located on a side surface of the side skirts 104 such that the proximity sensors 120 are spaced around a periphery of the treadmill 100. Additionally and/or alternatively, the proximity sensors can be located on any other portion of the treadmill 100, including but not limited to the support members 108 or the handrail 110. The proximity sensors 120 may include one or more infrared sensors, ultrasonic sensors, LED linear light sensors, or any other sensor configured to detect a presence of a person, animal, or object approaching the treadmill 100. For example, the proximity sensors 120 may be configured to detect the presence of any person within a predetermined radius of the proximity sensor 120 (e.g., 20-48 inches). The controller 314 may receive signals from the proximity sensors 120 indicating detection of the user or another person approaching the treadmill 100.

When the controller 314 receives signals from at least one of the proximity sensors 120 and the treadmill is not in use, the controller may initiate the display upon receipt of the signal, and the display may provide the user-initiation steps for using the treadmill, as a non-limiting example. When the controller 314 receives signals from at least one of the proximity sensors 120 and the treadmill 100 is in use, the display may warn the user that the treadmill is being approached.

The treadmill 100 may include peripheral lights 124 configured to illuminate an area on the floor surrounding the treadmill 100 to, for example, alert an approaching person that he or she is approaching a treadmill 100 that is in use, i.e., the tread 102 is moving. The peripheral lights 124 may be located on and/or under the side skirts 104, side rails 106 or handrails 110, and may include LED lights, lasers, projectors, or any other light source. The peripheral lights 124 may be of any color and may illuminate according to any predetermined or user-customized setting (e.g., flashing). The peripheral lights 124 may also change color according to any predetermined or user-customized setting. The lights 124 may project any symbols, words, patterns, or images onto the surrounding area in any configuration or orientation. As a non-limiting example, the peripheral lights 124 can form a light wall 126 on the floor around the treadmill 100 to warn approaching persons that the treadmill 100 is in use. The light wall may be spaced from the treadmill 100, such as 12-24 inches from the treadmill 100 and may surround the treadmill 100 partially or completely. The peripheral lights 124 can be yellow or red, for example, which are typically used to indicate a warning such as yield or stop.

The peripheral lights 124 may operate in conjunction with the controller 314 and other components of the treadmill 100 as follows. In response to the controller 314 determining that a subject is present within a predetermined radius of a treadmill 100 that is in use (e.g., in response to the proximity sensors 120 detecting the presence of an approaching person), the controller 314 may activate the peripheral lights 124 to illuminate the area surrounding the treadmill. In response to the proximity sensors 120 detecting the presence of a person approaching the treadmill 100 (e.g., from the side or from behind the treadmill 100), the display 112 may generate a notification for the user indicating to the user the approaching person's presence and location relative to the treadmill 100.

The controller 314 may activate the peripheral lights 124 to illuminate the area surrounding the treadmill and/or may change the color of the peripheral lights 124 in response to engagement of the brake 326 or in response to engagement of the lock 316. For example, the peripheral lights 124 may not be activated when the lock 316 is engaged.

One or more projectors 114 may be located on any portion of the treadmill 100, including but not limited to any portion of the handrail 110 (e.g., inside the handrail 110), the support members 108, and/or the side skirts 104. The projectors 114 may be configured to project an image onto a projection area 115. The projection area 115 may include any area nearby the treadmill (e.g., floors, walls, or ceiling). The image may include any previously described biometric and/or performance data associated with the user or another treadmill user. For example, the projectors 114 can project biometric or user performance data on the floor near the treadmill 100 to be viewed by judges during a competition. Additionally and/or alternatively, the projectors 114 can project advertising or marketing information such as a company logo. The projectors 114 may project the data onto any surface or surfaces near the treadmill 100 in response to a command issued by the user. The controller 314 may activate the projectors 114 in response to determining the user is present near the treadmill 100.

The treadmill 100 may include a lighting system configured to emit light from the tread. The lighting system may alert the user and other individuals that the treadmill 100 is operational, may warn individuals nearby the treadmill 100 not to approach to the treadmill 100, and may communicate biometric or performance information to the user or observers, such as judges in a competition.

As shown in FIG. 1, the tread 102 may be formed of multiple slats. The slats are configured to form a surface on which the user may exercise and are positioned next to adjacent slats to mimic a continuous belt, with a small space between adjacent slats. The lighting system includes lights positioned below the slats on which the user stands. The lights are located in a cavity defined on the top and bottom by the tread 102 that rotates on the front and rear axles 300, 302. The tread surface is the surface facing away from the cavity and includes the surface on which the user exercises. The lock 316, the brake 326, the front axle 300, rear axle 302, the front axle drum 304, and the rear axle drum 306 may be located in the cavity.

The lights may be configured to emit light away from the cavity and through the one or more spaces between the slats along any length of the tread 102. The lights may include LEDs, neon lights, or lights of any other type and may be included in a lighting strip or rope. The lights may also include one or more integrated circuits.

The lighting system may also include the controller 314 or any other controller configured to control the lights. The lights may be in communication (e.g., wired or wireless communication) with the controller 314 or any other controller. The lights may operate in conjunction with the controller 314 and other components of the treadmill 100. The controller 314 may control the activation, deactivation, color, brightness, and/or light emission frequency of the lights. The controller 314 may configured to control at least one of the color, brightness, or light emission frequency of the lights in response to receiving a signal from a biometric sensor shown in FIG. 1. The biometric sensor may include the non-contact skin temperature sensor 113, a heartrate sensor, one or more of the weight sensors 118, or any other sensor configured to detect biometric information associated with the user. The biometric sensor may be located on any portion of the treadmill 100. The controller 314 may also be configured to control at least one of the color, brightness, or light emission frequency of the lights in response to calculating biometric information of the user based on signals received from the biometric sensor, including but not limited to calories burned or body mass index. The biometric sensor may detect biometric information data associated with the user in response to a request from the user. Additionally and/or alternatively, the biometric sensor may detect biometric information associated with the user in response to the weight sensors 118 detecting the user's presence on the foot pads 122 and/or side rails 106.

The controller 314 may control at least one of the color, brightness, or light emission frequency of the lights based on performance data associated by the user, including but not limited to distance traveled, distance remaining, workout duration, workout time remaining, tread speed, user running pace, or any other user performance information; and/or data associated with another treadmill user.

The controller 314 may also activate the lights in response to receiving a signal from the proximity sensors 120 indicating the presence of a user or another individual near the treadmill 100. For example, when the treadmill is not in use, the proximity sensors 120 may detect that a person is approaching the treadmill 100 and send a signal to the controller 314 to activate the lights. The lights may be activated to invite the approaching person to use the treadmill 100, such as using certain colors or flashing lights. As another example, when the treadmill 100 is in use, the proximity sensors 120 may detect that a person is approaching the treadmill 100 and send a signal to the controller 314 to flash the already activated lights or to change the color of the lights to a color such as yellow or red to warn the approaching person that the tread 102 is moving. The controller 314 may flash and/or change the color of the lights located on an area of the treadmill 100 based on a location of the person approaching the treadmill 100 detected by the proximity sensors. For example, if the proximity sensor 120 detects a person approaching a rear of the treadmill, the controller 314 may flash and/or change the color the lights located on the rear of the treadmill 100.

The lights may include one or more sets of lights configured to illuminate different portions of the treadmill 100. For example, the lighting system may include a first set of lights configured to be controlled by the controller 314 to illuminate a front portion 128 (shown in FIG. 1) of the treadmill. The front portion of the treadmill 100 is associated with the location where slats approach the front axle 300 and turn around the front axle 300. The lighting system may include a second set of lights configured to be controlled by the controller 314 to illuminate a rear portion 130 (shown in FIG. 1) of the treadmill, where the rear portion 130 is opposite the front portion 128. The rear portion 130 is associated with the location where slats approach the rear axle 302 and turn around the rear axle 302. The lighting system may also include a third set of lights configured to illuminate a middle portion 130 (shown in FIG. 1) of the treadmill, where the middle portion 132 extends between the front portion 128 and the rear portion 130. The front portion, the rear portion, and the middle portion of the treadmill can be separately illuminated by the lights in any color, brightness, or light emission frequency in any combination. For example, the controller 314 may be configured to illuminate the front and rear portions of the treadmill 100 using a first color (e.g., yellow) and to illuminate the middle portion using a second color (e.g., green). By illuminating the front and rear portions of the treadmill 100 using a color typically associated with a warning, such as yellow, orange, or red, the lighting system may alert individuals nearby the treadmill 100 to use caution while near the treadmill 100.

Figure 9:
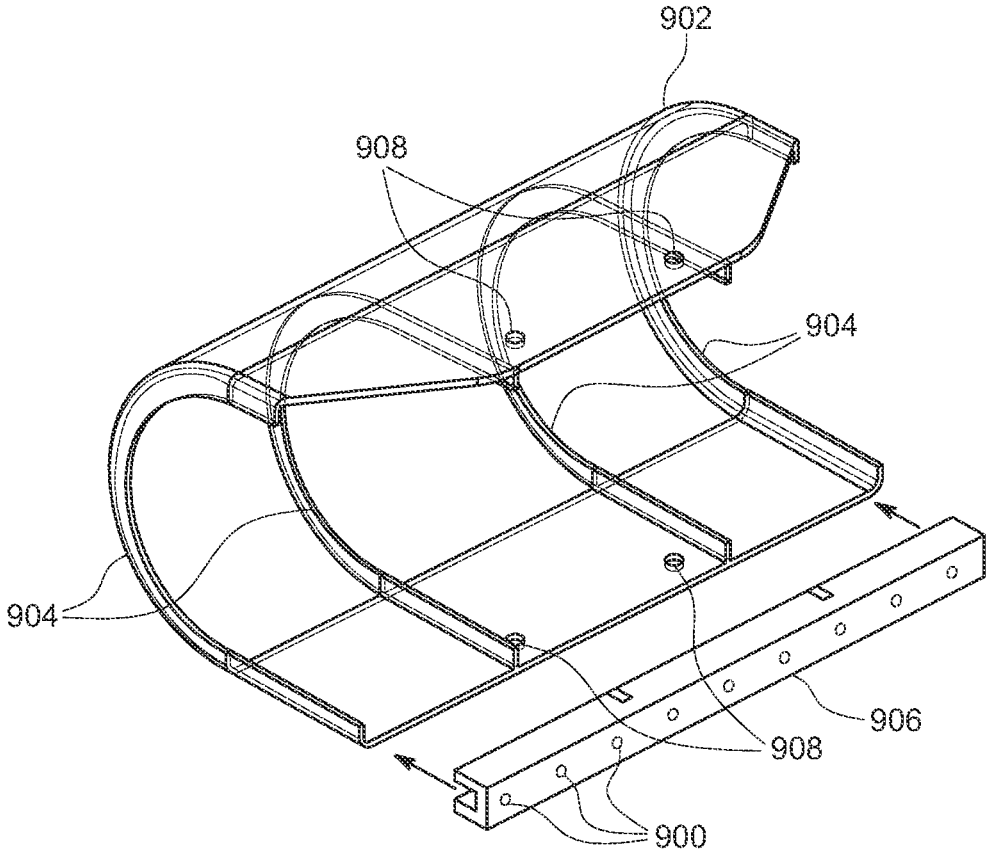
FIG. 9 is a top perspective view of lights configured to emit light through a first lens.

The lighting system may include lights located in the cavity that remain stationary with respect to the tread 102. FIG. 9 is a top perspective view of lights 900 configured to emit light through a first lens 902. The lights 900 may include features similar to those of the lights previously described. The first lens 902 may include a transparent or semi-transparent member configured to receive light from the lights 900 and to emit light through the tread 102 (not shown in FIG. 9). The first lens 902 may be made of any plastic such as acrylic, glass, or any other material configured to refract light emitted by the lights 900. The first lens 902 may have a curved shape and may extend around a portion of a circumference of the front axle 300, the rear axle 302, the front axle drum 304, or the rear axle drum 306. For example, the first lens 902 shown in FIG. 9 includes a plastic sheet having curved shape such that the first lens 902 may be attached to the treadmill 100 around a portion of a circumference of the front axle drum 304. The first lens 902 may be located upstream of the front axle 300 or the front axle drum 304 in relation to movement of the tread 102. In this position, the first lens 902 may illuminate the front portion of the treadmill when the lights 900 are activated. The first lens 902 may include ribs 904 extending along a length of the first lens 902 to structurally reinforce the first lens 902.

A second lens (not shown) having features similar to those of the first lens 902 may include a curved shape and may extend around a portion of a circumference of the rear axle 302 or the rear axle drum 306 such that the rear portion of the treadmill 100 may be illuminated. The second lens may be located in the cavity downstream of the rear axle 302 or the rear axle drum 306 in relation to the movement of the tread 102. A second set of lights (not shown) having features similar to those of the lights 900 may be attached to the second lens.

The lights 900 may be positioned and/or configured in the cavity such that the lights 900 emit light through the first lens 902 to illuminate a portion of the tread 102. For example, the lights may be positioned on an edge of the first lens 902 such that light emitted by the lights 900 is refracted by the first lens 902 and emitted through the spaces between adjacent slats of the tread 102. In the illustrated, non-limiting example, the lights 900 are located on a housing 906. The housing 906 is attached to an edge of the first lens 902 such that the lights 900 emit light through the first lens 902. In other embodiments, the housing 906 may be attached to any portion of the first lens 902. The housing 906 may include a bracket configured to attach to the first lens 902, a transparent flexible tube in which the lights 900 are located, an elongate strip, or any other device configured to attach the lights 900 to the first lens 902. In other embodiments, the lights 900 may be directly attached to the first lens 902. In other embodiments, the lights 900 may not be connected to the first lens 902 and may be located near the first lens 902 such that the lights 900 emit light through the first lens 902. The first lens 902 may include apertures 908 to attach the first lens 902 to the frame 202, a lens bracket, or any intermediate component, or any other component of the treadmill 100.

Figure 10:
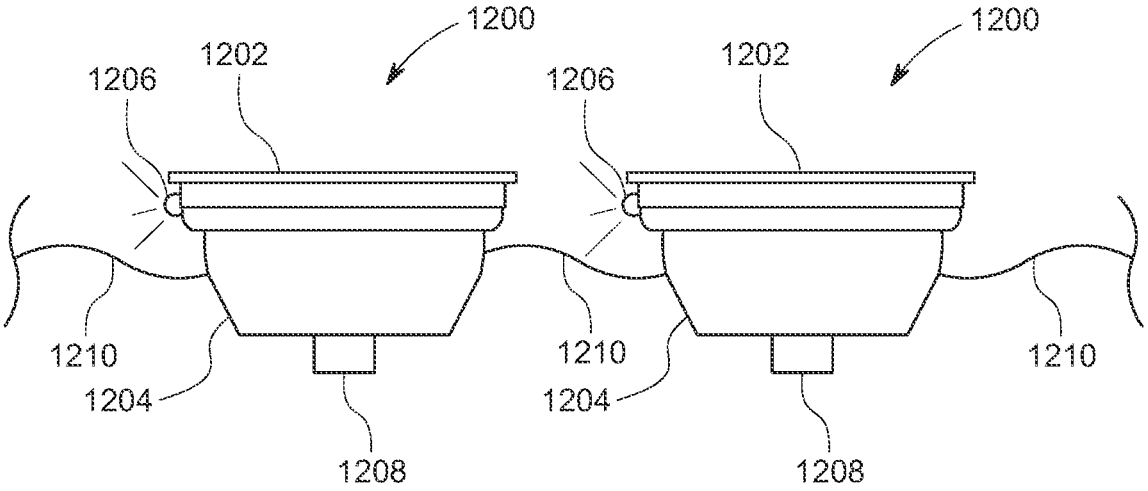
FIG. 10 is a side view of a slat of the tread.

The lighting system may include lights located on the slats forming the tread 102 such that the lights rotate with the tread 102 around the front axle 300 and the rear axle 302. FIG. 10 is a side view of a slat 1200. The slat 1200 may include a tread surface 1202 on which the user exercises. The slat 1200 may also include an underside 1204 which includes any surface of the slat 1200 that is not the tread surface 1202, including any side surfaces. One or more lights 1206 may be attached to the underside 1204 of the slat such that the lights 1206 emit light through the spaces between adjacent slats forming the tread 102 or between slats and the side rails 106. The lights 1206 may include features similar to those of any lights previously described. In the illustrated, non-limiting example, a series of lights 1206 are attached to each of the front and back surfaces of the underside 1204 of the slat 1200. In other embodiments, a series of lights 1206 may be attached to only one of the front or back surface of the underside 1204. The lights 1206 may be attached to the underside 1204 of the slat 1200 using a housing as previously described. For example, a light rope or light bar may be attached to a leading edge or side edge of the underside of each slat 1200. Lights 1206 may also be within the tread surface 1202, such as between treads, such that the lights are not contacted by the user when the user steps on the slat 1200.

The lights 1206 attached to each slat 1200 may be controlled by a controller. The controller may include the controller 314 or any other controller. The controller 314 may be configured to control the activation, deactivation, color, brightness, and/or light emission frequency of the lights 1206. Alternatively, each slat 1200 may include a light controller attached to the underside 1204 of the slat 1200. Each light controller may be configured to control the lights 1206 of each respective slat in the same manner as the controller 314. Each light controller may be in communication with the controller 314.

The controller 314 may be configured to control the activation, deactivation, color, brightness, and/or light emission frequency of the lights 1206 attached to the slat 1200 in response to determining the position of the slat 1200 relative to the treadmill. For example, the controller 314 may control the lights 1206 to emit light in a first color (e.g., yellow) in response to determining that the slat 1200 is located in the front portion or the rear portion of the treadmill 100. The controller 314 may also control the lights 1206 to emit light in a second color (e.g., green) in response to determining that the slat 1200 is located in the middle portion of the treadmill 100.

To power lights when the treadmill 100 is not moving, the battery 310 or a motor can be sued. To power the lights while the slats are moving, the slat 1200 may include a contactor 1208 attached to the underside 1204 and in electrical communication with the lights 1206. The contactor 1208 may be attached to the underside 1204 within a recess defined by the underside 1204. The contactor 1208 may receive power from a power rail (further described with respect to FIG. 11) that extends along a length of the treadmill 100 and that is located in the cavity 1000. The power received by the contactor 1208 may be supplied to the lights 1206. The contactor 1208 receives power from the power rail, which remains stationary with respect to the tread 102, in response to contacting the power rail while the slat 1200 rotates around the front and rear axles. The contactor 1208 may include a motor brush (e.g., carbon brush) or any other component configured to receive power from the power rail and supply the power to the lights 1206. The slat 1200 may include multiple contactors 1208, including a contactor for conducting a positive charge and a contactor for conducting a negative charge. The slat 1200 may include contactors 1208 located at opposing longitudinal ends of the slat 1200.

Figure 11:
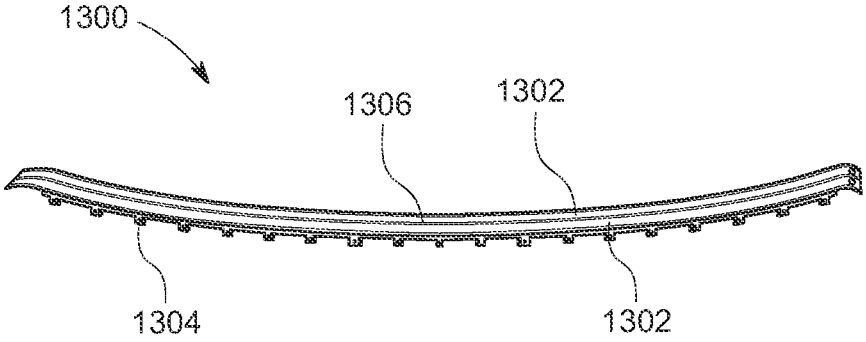
FIG. 11 is a top perspective view of a power rail.

FIG. 11 is a top perspective view of a power rail 1300. The power rail 1300 may include an elongate, member configured to supply power to the contactor 1208 in response to contacting the contactor 1208 as the slats (e.g., the slat 1200) rotate around the front and rear axles. The power rail 1300 may receive power from the battery 310, the power cord, the electric motor, or any other power source. The power rail 1300 may be shaped to receive the contactor 1208 as the contactor 1208 and the slat 1200 rotate around the front and rear axles. For example, the power rail 1300 may include one or more channels configured to receive the contactor 1208.

The power rail 1300 may include one or more strips of conductive material 1302 (e.g., copper) attached to an insulator member 1304. The strip of conductive material 1302 supplies power to the contactor 1208 while the strip of conductive material 1302 and the contactor 1208 are in contact. The insulator member 1304 may be made of any insulating material (e.g., rubber or plastic) and may electrically insulate the strips of conductive material 1302 from other components of the treadmill 100. The insulator member 1304 may include a wall 1306 configured to electrically insulate the strips of conductive material 1302 from each other (e.g., to separate positive contact and negative ground). Each of the strips of conductive material 1302 may receive one contactor 1208. For example, one strip of conductive material 1302 may receive a first contactor and another strip of conductive material 1302 may receive a second contactor. The insulator member 1304 may be connected to the bearing supports 1008, to any portion of the frame 202, or to any other component of the treadmill 100 such that the contactor 1208 may contact the strips of conductive material 1302 while the slat 1200 rotates around the front and rear axles.

As the slats 1200 rotate around the front and rear axles, the contactors 1208 attached to the undersides 1204 of the slats 1200 contact the power rail 1300 and supply power to the lights 1206 attached to the respective slats 1200. While powered, the lights 1206 emit light through the spaces between adjacent slats to illuminate portions of the treadmill 100. In some embodiments, every slat 1200 includes a contactor 1208. The contactor 1208 of each slat may be configured to supply power to the lights 1206 connected to the underside of each respective slat 1200 in response to contacting the power rail 1300. In such embodiments, when slats 1200 rotate such the contactors 1208 no longer contact the power rail 1300, the lights 1206 attached to the slats 1200 are not powered and do not emit light. The power rail 1300 may therefore be located in positions within the cavity 1000 where illumination of the treadmill 100 is desired. For example, the power rail 1300 may be positioned near a top of the cavity 1000 such that the power rail 1300 powers lights 1206 attached to slats 1200 that are presently located in the middle portion of the treadmill 100 as the slats 1200 rotate around the front and rear axles. In another example, portions the power rail 1300 may extend around the front and rear axles of the treadmill 100. In this configuration, the power rail 1300 may power lights 1206 attached to slats 1200 to illuminate the front, rear, and/or middle portions of the treadmill 100 as the slats 1200 rotate around the front and rear axles.

In other embodiments, only some of the slats forming the tread 102 may include a contactor 1208. In such embodiments, the slats including the contactor 1208 may be electrically connected to slats not including the contactor 1208 using one or more conductors 1210 (shown in FIG. 10). The conductor 1210 may be in electrical communication with the contactor 1208. The conductor 1210 can include a jumper wire or any other electrical connector. The conductor 1210 supplies power from the contactor 1208 in contact with the power rail 1300 to lights 1206 attached to slats 1200 that do not include contactors 1208. In other words, the lights 1206 connected to slats other than the slat including the contactor 1208 may receive power from the conductor 1210 in response to the contactor 1208 contacting the power rail 1300. In this configuration, the number of slats 1200 including contactors 1208 may be reduced. For example, if the tread 102 includes 64 slats connected in series, one of every 32 slats in the series may include a contactor 1208 such that one contactor 1208 is always in contact with the power rail 1300 as the tread 102 rotates around the front and rear axles. In this example, the lights 1206 attached to the 62 slats that do not include a contactor 1208 may be powered by the conductor 1210. The contactor 1208 and the conductor 1210 may power the lights 1206 attached to each slat 1200 to illuminate the front, rear, and middle portions of the treadmill 100.

Figure 12:
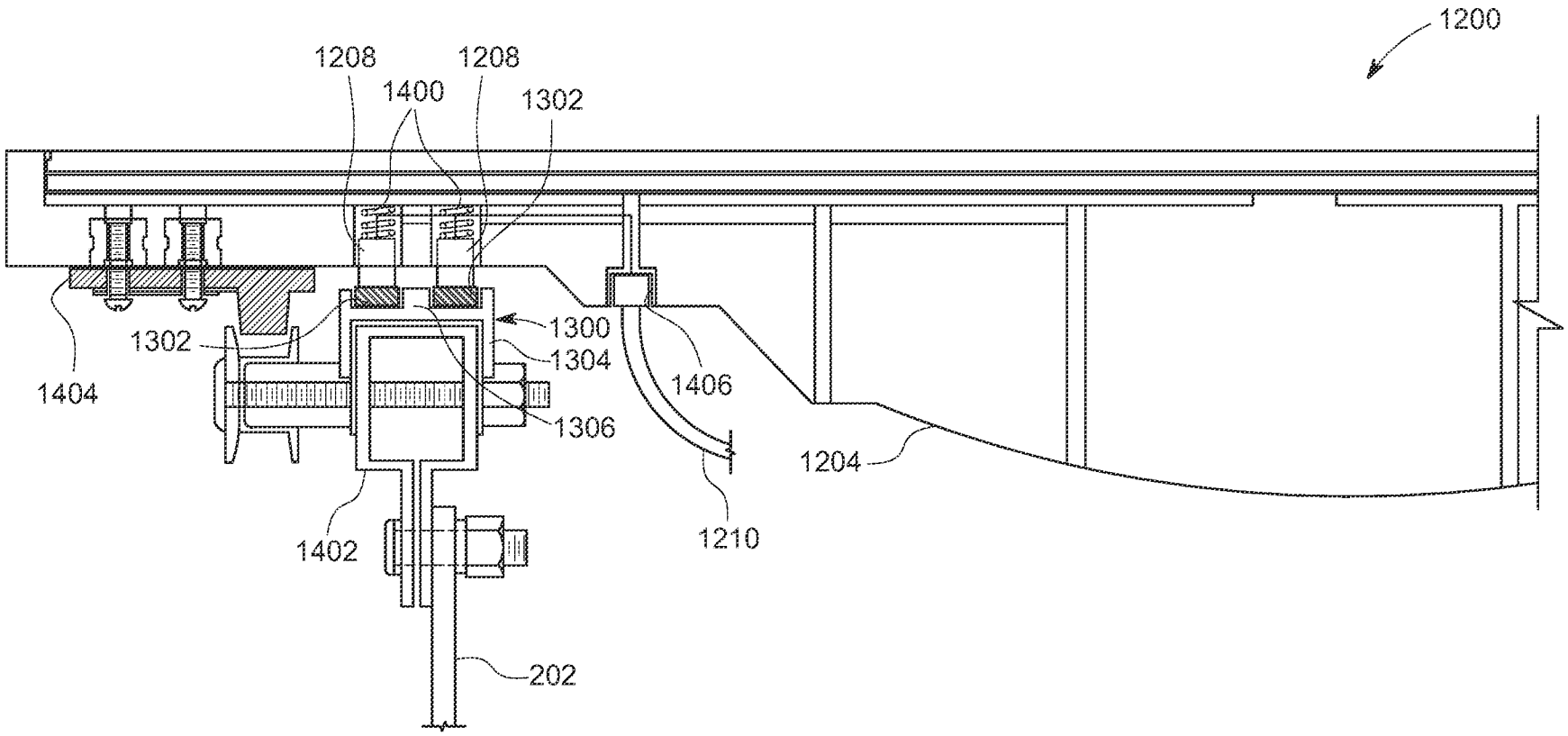
FIG. 12 is a partial rear view of the slat including a contactor contacting the power rail according to one embodiment.

FIG. 12 is a partial rear view of the slat 1200 including the contactor 1208 contacting the power rail 1300 according to one embodiment. In the illustrated, non-limiting example, two contactors 1208 are attached to the underside 1204 of the slat 1200. One end of each contactor 1208 is in contact with the strips of conductive material 1302 of the power rail 1300. The opposite end of each contactor 1208 includes an actuator 1400 (e.g., spring) configured to maintain contact between the contactor 1208 and the strip of conductive material 1302. The strips of conductive material 1302 are connected to the insulator member 1304. The wall 1306 separates and insulates the strips of conductive material 1302 from each other. The insulator member 1304 is connected to a bearing support 1402. The bearing support 1402 may support bearings (not shown) configured to enable rotation of the belt 1404 around the front and rear axles. One end of the slat 1200 is connected to the belt 1404. Another belt (not shown) may be connected to the slat 1200 at the opposite end of the slat 1200. The bearing support 1402 is connected to the frame 202. The conductor 1210 is connected to the underside 1204 of the slat 1200 in a recess 1406.

The treadmill 100 may include a combination of stationary lighting located in the cavity 1000 and lights 1206 attached to the underside 1204 of slats 1200. As previously described, the lighting system may include a first set of lights configured to illuminate a front portion of the treadmill 100, and a second set of lights configured to illuminate a rear portion of the treadmill 100. Any of first set of lights and the second set of lights may include embodiments of the lighting system described with respect to FIGS. 9-12 in any combination. For example, the first set of lights may include the first lens 902 extending around the front axle drum 304 and the lights 900 attached to the lens 902 as previously described. The second set of lights may include the second lens extending around the rear axle drum 306 and the lights attached to the second lens as previously described. The power rail 1300 may extend along a length of the middle portion of the treadmill 100 such that the lights 1206 are only powered to emit light as they rotate through the middle portion of the treadmill 100 along a top of the cavity 1000. In this configuration, the lights 1206 are not powered as the slats 1200 are rotated through the front and rear portions of the treadmill. In other embodiments, the power rail 1300 may also be positioned such that the lights 1206 are only powered as the slats 1200 are rotated through the front and/or rear portions of the treadmill. Alternatively, the lights 1206 may be controlled by the controller 314 to emit light in response to the controller 314 determining that the lights 1206 are located in the middle portion of the treadmill 100.

The lighting systems described herein can be used in many different ways, some of which are described here. For example, the lights may be turned on when the proximity sensor detects a person approaching the treadmill 100. The lights may be controlled to flash as a warning to the approaching person. The lights may be turned on and to a color such as green inviting the approaching person to use the treadmill 100. The lighting systems may be used while the treadmill is in operation. The lights may be used while the tread is rotating to warn others around the treadmill that the tread is moving. The lights may be used to vary color in response to the user's temperature as measured by the non-contact temperature sensor. The lights may be used to indicate the speed of the tread. The lights may be used to indicate a safe region on the tread for which the user to stay when exercising.

Figure 13:
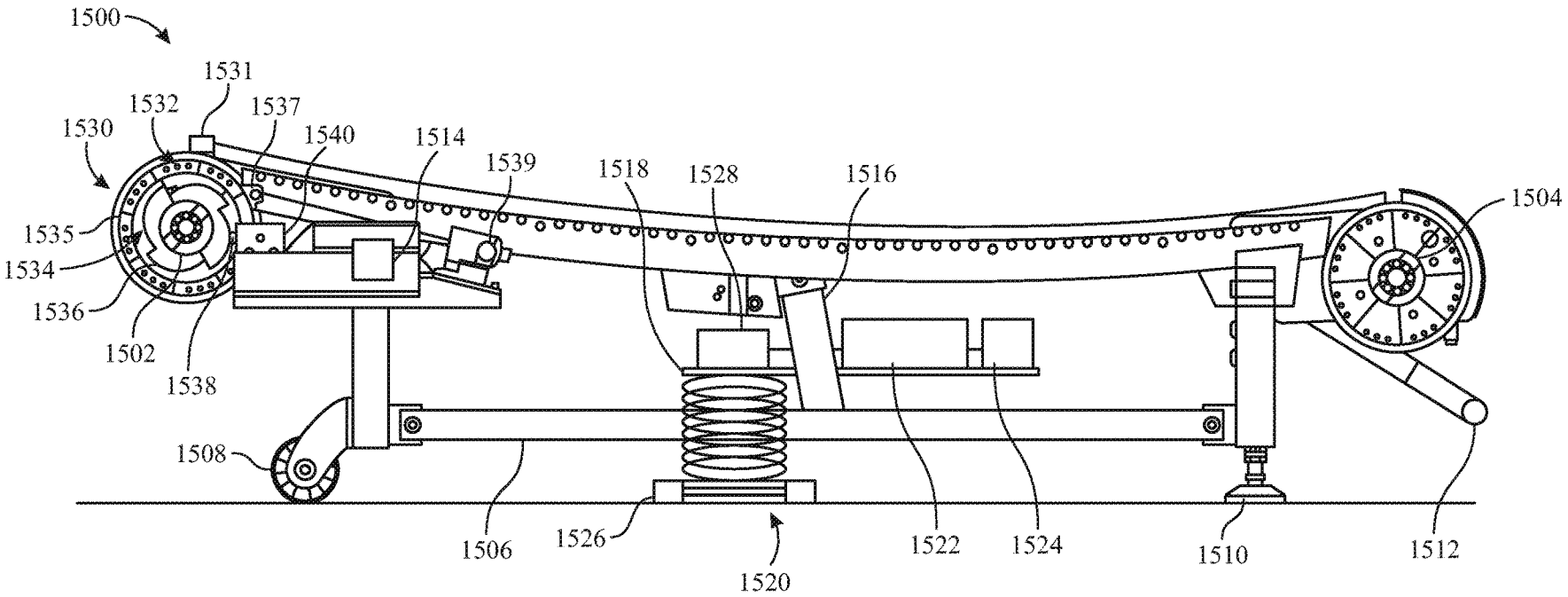
FIG. 13 is a side view of a treadmill according to another embodiment.

FIG. 13 is a side view of a treadmill 1500 according to another embodiment. The treadmill 1500 includes features similar to those of the treadmill 100 except as otherwise described. The treadmill 1500 is a manual treadmill including a front axle 1502 having features similar to those of the front axle 300, a rear axle 1504 having features similar to those of the rear axle 302, and a frame 1506 having features similar to those of the frame 202 except as otherwise described. Two wheels 1508 are attached to one end of the frame 1506 proximate to the front axle 1502. Two floor supports 1510 are attached to an opposite end of the frame 1506. The floor supports 1510 are configured to contact a floor surrounding the treadmill 1500 to prevent the frame 1506 from moving relative to the floor. A handle 1512 is attached to the frame 1506 proximate to the rear axle 1504. The user may use the handle 1512 to lift one end of the treadmill 1500 to move the treadmill 1500 using the wheels 1508. In other embodiments, the treadmill 1500 may include more or less than two wheels 1508 and floor supports 1510. In other embodiments, the treadmill 1500 may not include the wheels 1508, the floor supports 1510, or the handle 1512. In yet other embodiments, the wheels 1508, the floor supports 1510, and the handle 1512 may be attached to any portion of the treadmill 1500 (e.g., proximate to either the front axle 1502 or the rear axle 1504).

The treadmill 1500 includes a wireless charging system 1520 including a battery 1522 having features similar to those of the battery 310, a power transmitter 1526, and a power receiver 1528, each in communication with a controller 1524 having features similar to those of the controller 314. The battery 1522, the controller 1524, and the power receiver 1528 are supported by support member 1518. In other embodiments, the battery 1522, the controller 1524, and the power receiver 1528 may be collectively or individually attached to any other portion of the treadmill 1500, such as support members 1514, 1516.

The power transmitter 1526 is configured to transmit power wirelessly from a power source (e.g., a wall outlet) to the power receiver 1528 via inductive coupling. In other embodiments, any suitable method of wireless power transfer may be used. The power receiver 1528 is configured to receive the power from the power transmitter 1526 and to supply the power to the battery 1522 for recharging. The power transmitter 1526 may be placed on the floor underneath the treadmill 1500. In this position, the treadmill 1500 and the power receiver 1528 may be moved over the power transmitter 1526 to power the treadmill 1500 and/or recharge the battery 1522. In other embodiments, the power transmitter 1526 may be attached to the treadmill 1500.

The treadmill 1500 includes a braking system 1530 that may be used to improve the operation of manual treadmills such as the treadmill 1500. For example, the braking system 1530 may be used to slow and/or stop rotation of the treadmill tread while a user operates the treadmill, while the user takes a momentary break from using the treadmill, when the user accidentally stops using the treadmill, or when the user purposefully stops using the treadmill. These features provide an advantage over typical manual treadmills that lack any braking and/or locking systems. For example, immediately after a user steps off of the rotating tread of a manual treadmill, the rotation speed of the tread can suddenly increase due to kinetic energy. This increase in tread speed can put the user or subsequent users at risk. The braking system 1530 may prevent or mitigate such increases in tread speed and may stop or slow rotation of the tread while not in immediate use, facilitating easier operation of the treadmill by the user or subsequent users.

The braking system 1530 includes presence sensors (not shown) having features similar to those of presence sensors 116, weight sensors (not shown) having features similar to those of the weight sensors 118, proximity sensors (not shown) having features similar to those of proximity sensors 120, and a tread sensor 1531, each in communication with the controller 1524. The tread sensor 1531 is configured to detect a speed of a tread (not shown) of the treadmill 1500 having features similar to those of the tread 102. The braking system 1530 may be used with the treadmill 100 of FIGS. 1-12 instead of or in addition to the brake 326, the brake 700, the lock 316, and/or the lock 400. The braking system 1530 may be useful when used in combination with manual treadmills.

The braking system 1530 includes a magnetic brake 1532 configured to slow rotation of the front axle 1502 and/or the rear axle 1504 and a locking mechanism 1534 having features similar to the lock 316 or the lock 400 except as otherwise described. The magnetic brake 1532 includes a braking member receiver 1535, a braking member 1537, and an actuator 1539. The braking member receiver 1535 is configured to be attached to the front axle 1502 or the rear axle 1504. The actuator 1539 is configured to move the braking member 1537 relative to the braking member receiver 1535 between a braking position and a non-braking position. In the braking position, the braking member 1537 is configured to apply a braking force to the braking member receiver 1535. In the non-braking position, the braking member 1537 is configured not to apply the braking force to the braking member receiver 1535. Rotation speed of the braking member receiver 1535, the front axle 1502 or the rear axle 1504, and the tread is decreased in response to application of the braking force to the braking member receiver 1535.

The locking mechanism 1534 includes a locking member receiver 1536 having features similar to those of the locking member receiver 320 and/or the toothed cam 408, a locking member 1538 having features similar to those of the locking member 318 and/or the bolt 416, and an actuator 1540 having features similar to those of the actuator 322 and/or the solenoid 414. The actuator 1540 is configured to move the locking member 1538 between a locked position and an unlocked position. In the locked position, the locking member 1538 and the locking member receiver 1536 prevent the front axle 1502 and/or the rear axle 1504 and the tread from rotating. In the unlocked position, the front axle 1502 and/or the rear axle 1504 and the tread are allowed to rotate freely.

Figure 14:
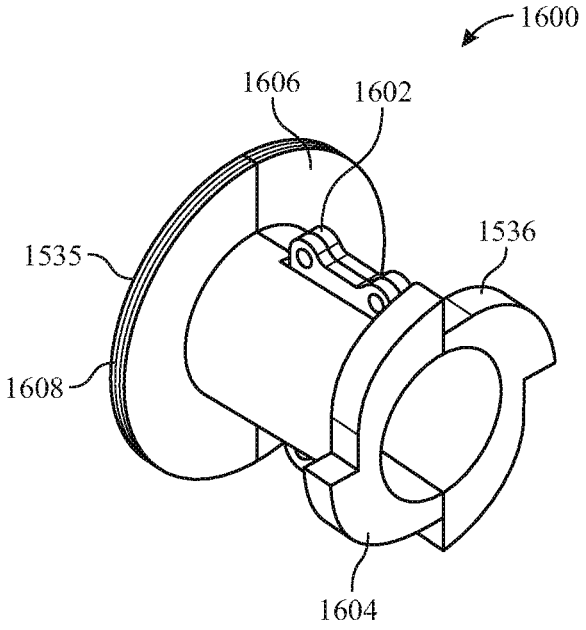
FIG. 14 is a top perspective view of a braking member receiver and a locking member receiver according to one embodiment.

FIG. 14 is a top perspective view of the braking member receiver 1535 and the locking member receiver 1536 according to one embodiment in which the braking member receiver 1535 and the locking member receiver 1536 are included in a coupling 1600. The coupling 1600 is configured to extend around the front axle 1502, but in other embodiments may be configured to extend around the rear axle 1504. The coupling 1600 includes two halves that are attached together via flanges 1602 and fasteners such as nuts and bolts. In this configuration, the coupling 1600 may be attached to an axle of an existing treadmill such that the braking system 1530 may be retrofit to the existing treadmill. In other embodiments, the coupling 1600 may include one integral piece and/or may be originally manufactured with a treadmill. In the illustrated, non-limiting example, the locking member receiver 1536 includes a toothed cam 1604 that extends from the coupling 1600 at an end of the coupling 1600. In other embodiments, the toothed cam 1604 may extend from any portion of the coupling 1600. The toothed cam 1604 includes features similar to those of the toothed cam 408. In other embodiments, any other suitable cam may be used.

In the illustrated, non-limiting example, the braking member receiver 1535 includes a flange 1606 extending from the coupling 1600 at an end of the coupling 1600 opposite the toothed cam 1604. In other embodiments, the flange 1606 may each extend from any portion of the coupling 1600. The flange 1606 is round, but in other embodiments can have any other exterior profile. At least a portion of the flange 1606 includes a metal and/or a magnetic material such as copper, aluminum, iron, cobalt, nickel, or the like. The flange 1606 includes a groove (not shown) extending around a periphery of the flange 1606. A damper 1608 extends around the flange 1606 inside the groove. The damper 1608 is configured to suppress vibration of the flange 1606 while the flange 1606 rotates. The damper may include a "T" shape and have a protrusion configured to extend into the groove. In other embodiments, the damper may include an O-ring. The damper 1608 may be made of rubber or any other suitable material. In some embodiments, the coupling 1600 may not include the damper 1608 or the groove.

Figure 15:
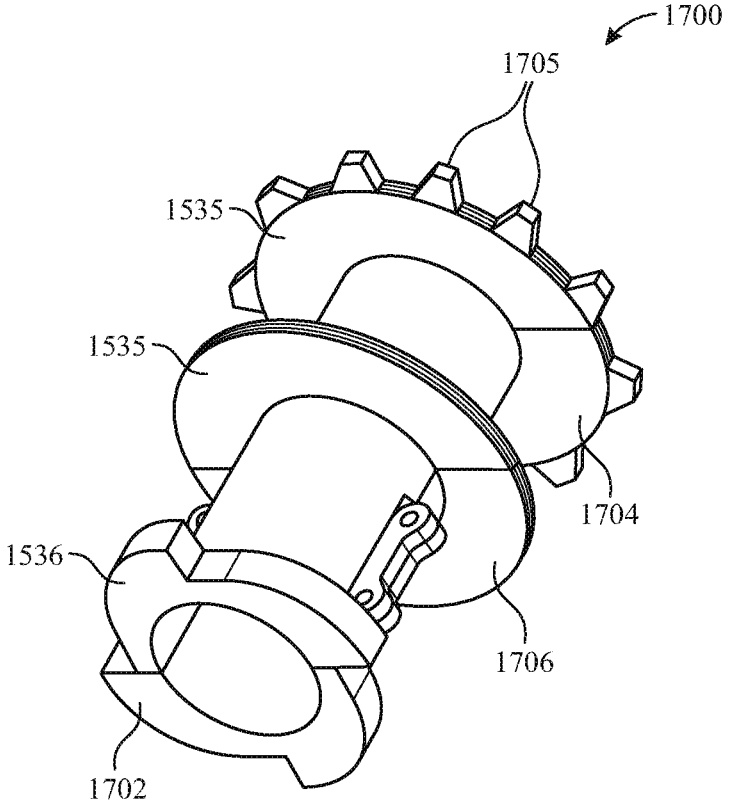
FIG. 15 is a top perspective view of a braking member receiver and a locking member receiver according to another embodiment.

FIG. 15 is a top perspective view of the braking member receiver 1535 and the locking member receiver 1536 according to another embodiment in which the braking member receiver 1535 and the locking member receiver 1536 are included in a coupling 1700. The coupling 1700 includes features similar to those of the coupling 1600 except as otherwise described. The coupling 1700 includes a toothed cam 1702 having features similar to those of the toothed cam 1604. The toothed cam 1702 extends from one end of the coupling 1700, but in other embodiments may extend from any portion of the coupling 1700. A first flange 1704 having features similar to those of the flange 1606 extends from an end of the coupling 1700 opposite the toothed cam 1702. The first flange 1704 is round, but in other embodiments can have any other exterior profile.

As illustrated in FIG. 15, the first flange 1704 optionally is a slat-engaging mechanism, such as a sprocket wheel or similar, including one or more teeth 1705 extending from an edge of the first flange 1704 configured to contact a portion (e.g., the underside 1204) of one or more of the slats 1200. In this configuration, contact between the first flange 1704 and the slat(s) 1200 will prevent movement of the tread when the locking mechanism 1534 is in the locked position by preventing the belt and slats from moving. The belt and slats can move even if the locking mechanism 1534 is actuated because the belt and slats can slip over the guide wheels. This can occur if a child climbs on the tread when the lock is engaged, for example. The teeth 1705 have a shape, such as rectangular, hooked, etc. that will just contact the slat to prevent movement of the slat, and thus the belt. Rather than teeth, the slat-engaging mechanism can have a paddle, such as on a paddle wheel, that engages a slat to prevent movement. The entire first flange 1704 and teeth 1705 of the sprocket wheel or just the teeth 1705 may be made from plastic, such as ABS or LEXAN plastic, or can be made from a metal such as aluminum. The sprocket wheel can be a single disk independent of the brake and mounted at a different location on one of the axles, or can be incorporated into the first flange 1704 as illustrated, or incorporated into any other flange.

A second flange 1706 having features similar to those of the first flange 1704 extends from the coupling 1700 at a location between the toothed cam 1702 and the first flange 1704. In other embodiments, the first flange 1704 and the second flange 1706 may extend from any portion of the coupling 1700. The second flange 1706 may also or solely include one or more of the teeth 1705 to prevent movement of the tread by contacting the slat(s). In other embodiments, only the first flange 1704 may include one or more of the teeth 1705, or both the first flange 1704 and the second flange 1706 may include one or more of the teeth 1705.

Figure 16:
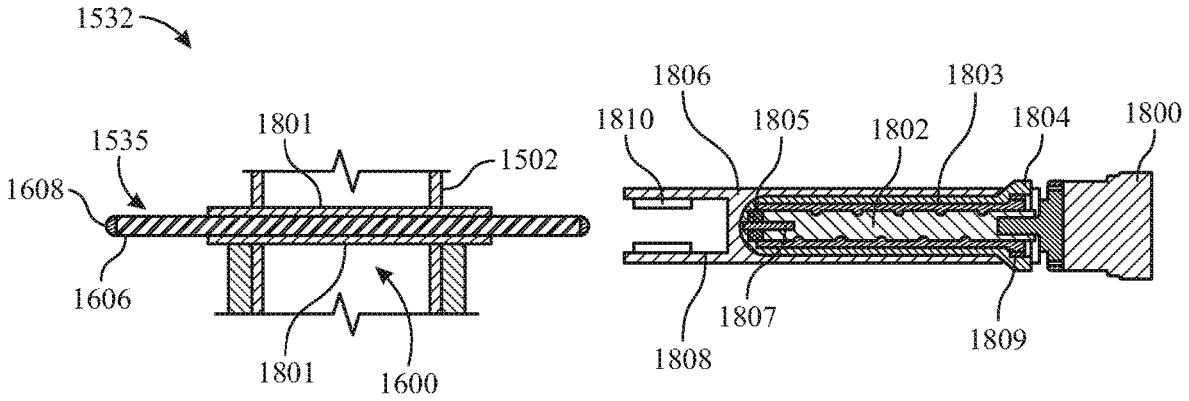
FIG. 16 is a top view of a brake according to one embodiment.

FIG. 16 is a top view of the magnetic brake 1532 according to a first embodiment. The braking member receiver 1535 includes the flange 1606 extending from the coupling 1600. The coupling 1600 may be attached to the front axle 1502 or to the rear axle 1504. The flange 1606 includes protrusions 1801 extending from each side of the flange 1606. The protrusions 1801 can include washers or any other suitable structure integral with or separately attached to the flange 1606. The brake 1532 includes a motor 1800 (e.g., an electric stepper motor) in communication with the controller 1524 and configured to rotate a self-reversing screw 1802 attached to the motor 1800. In other embodiments, any type of motor may be used. In other embodiments, the self-reversing screw 1802 may include a lead screw or a screw of any other type. The self-reversing screw 1802 is disposed in a housing 1804 attached to the motor 1800. An end of the self-reversing screw 1802 engages a ball bearing 1805 configured to prevent the self-reversing screw 1802 from oscillating and to maintain alignment between the self-reversing screw 1802 and the flange 1606. The ball bearing 1805 is attached to the self-reversing screw 1802 using a pin 1807. In other embodiments, the ball bearing 1805 may be attached to the self-reversing screw 1802 using any other means. Alternatively, the brake can be operated without a motor by using a compressed spring and gradually releasing the spring using a controlled lever and cable, the cable attached on the treadmill handle bar.

The housing 1804 defines a slot (not shown) that extends along a length of the housing 1804. A nut 1803 positioned between the self-reversing screw 1802 and the housing 1804 is configured to move linearly along a length of the self-reversing screw 1802 in response to rotation of the self-reversing screw 1802. A portion of the nut 1803 extends through the slot in the housing 1804 such that the slot guides the linear motion of the nut 1803. The nut 1803 is attached to a magnet member 1806 such that the magnet member 1806 moves linearly relative to the housing 1804 in response to rotation of the self-reversing screw 1802. In other embodiments, any type of mechanical, electromechanical, hydraulic, pneumatic, piezoelectric, or rotation-to-linear actuator may be used to move the magnet member 1806. Another ball bearing 1809 is disposed between the nut 1803 and the housing 1804 at an end of the housing 1804 opposite the ball bearing 1805.

The magnet member 1806 defines a channel 1808. Magnets 1810 are attached to the magnet member 1806 inside the channel 1808. Three magnets 1810 are attached to each side of the channel 1808, but in other embodiments any number of magnets 1810 may be used. The magnets 1810 may include permanent magnets or electromagnets. The magnets 1810 are configured to apply a magnetic force to the flange 1606. An interior profile of the channel 1808 corresponds to an exterior profile of the flange 1606 such that when the motor 1800 moves the magnet member 1806 towards the flange 1606, a portion of the flange 1606 is disposed in the channel 1808. In this position, the magnets 1810 apply a magnetic force to the flange 1606 to slow rotation of the flange 1606. As a result, rotation of the front axle 1502 or the rear axle 1504 and the tread are slowed. A distance between the magnet member 1806 and the flange 1606 may be decreased using the motor 1800 to apply a greater magnetic force to the flange 1606 and to more quickly slow rotation of the front axle 1502 or the rear axle 1504 and the tread.

The motor 1800 may be configured to move the magnet member 1806 until the damper 1608 of the flange 1606 contacts an interior surface of the channel 1808 of the magnet member 1806. The contact between the damper 1608 and the magnet member 1806 may further slow rotation of the flange 1606.

Figure 17:
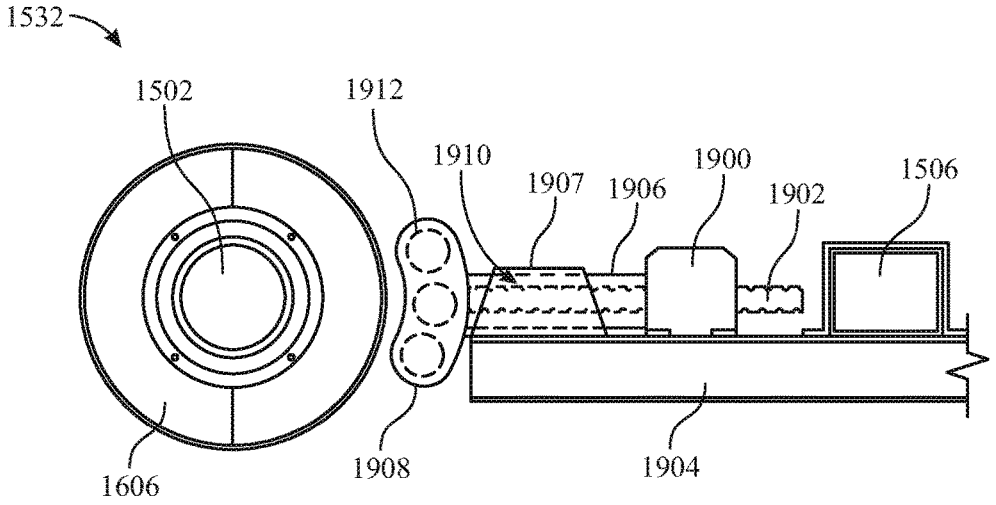
FIG. 17 is a side view of a brake according to another embodiment.

FIG. 17 is a side view of the magnetic brake 1532 according to a second embodiment where the brake 1532 is another magnetic brake. The brake 1532 according to the second embodiment shown in FIG. 17 may include features similar to those of the brake 1532 according to the first embodiment shown in FIG. 16 except as otherwise described. The brake 1532 includes a motor 1900 (e.g., an electric stepper motor) in communication with the controller 1524 and configured to rotate a lead screw 1902 attached to the motor 1900. In other embodiments, any type of motor may be used. The stepper motor 1900 is attached to a bracket 1904 configured to connect the brake 1532 to any portion of the frame 1506 (e.g., a first support member 1514). The lead screw 1902 is attached to and disposed in a first housing 1906. The first housing 1906 has a square shape but in other embodiments may have any other shape. A second housing 1907 defining a channel 1910 is attached to the bracket 1904. The channel 1910 is shaped and sized to receive the first housing 1906. The first housing 1906 and the lead screw 1902 extend through the channel 1910 such that rotation of the lead screw 1902 by the motor 1900 results in linear motion of the first housing 1906 in a longitudinal direction relative to the first housing 1906. An end of the first housing 1906 is attached to a magnet member 1908 having features similar to those of the magnet member 1806. Linear movement of the lead screw 1902 and the first housing 1906 results in movement of the magnet member 1908 relative to the flange 1606. The magnet member 1908 includes magnets 1912 disposed inside a channel (not shown) defined by the magnet member 1908. The channel includes features similar to those of the channel 1808 and the magnets include features similar to those of the magnets 1810.

Figure 18:
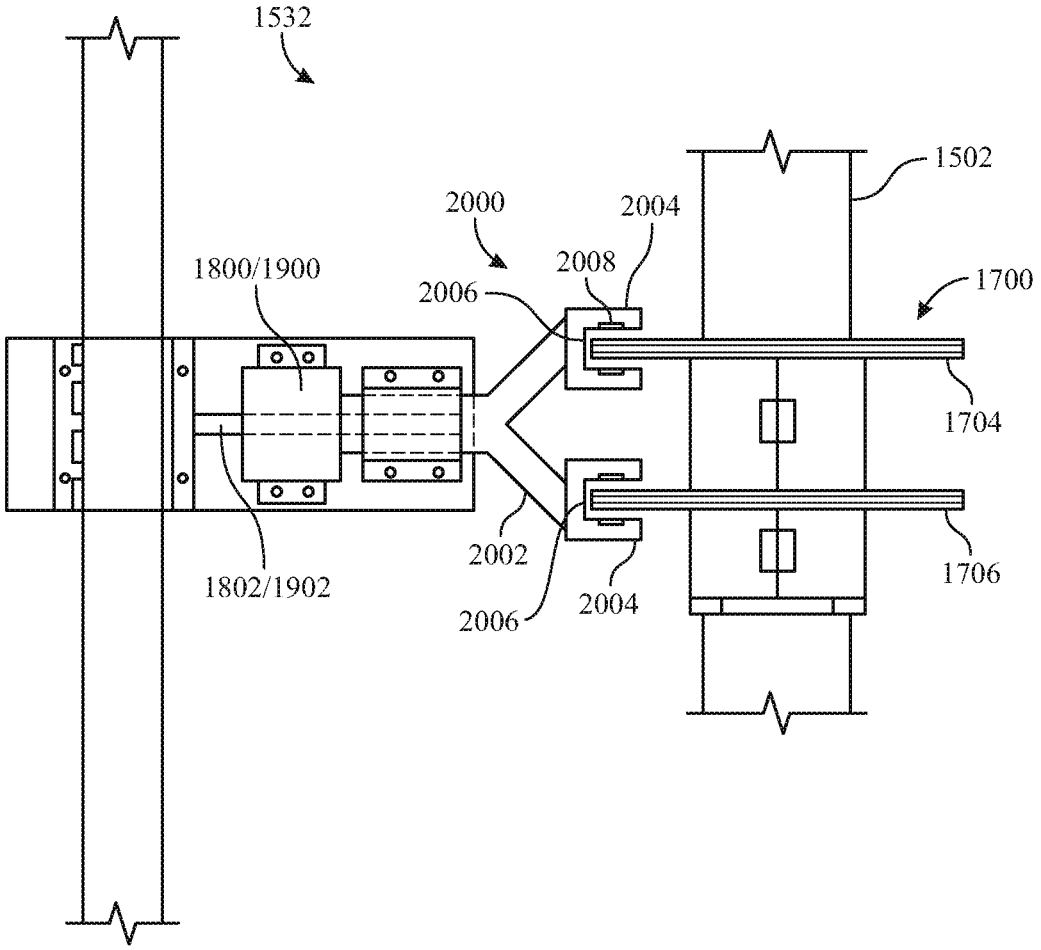
FIG. 18 is a top view of a magnet member and the braking member receiver of FIG. 15.

FIG. 18 is a top view of a magnet member 2000 according to another embodiment and the coupling 1700 of FIG. 15. The magnet member 2000 includes features similar to those of the magnet member 1806 or the magnet member 1908 except as otherwise described. The magnet member 2000 may be used with the brake 1532 described with respect to FIG. 16 or FIG. 17. The magnet member 2000 includes a magnet support member 2002 attached at one end to the self-reversing screw 1802 or the lead screw 1902. In the illustrated, non-limiting example, the magnet support member 2002 is Y-shaped, but in other embodiments may include a C-shape or any other suitable configuration. An opposing end of the magnet support member 2002 is attached to two magnet retaining members 2004. Each of the magnet retaining members 2004 defines a channel 2006. Magnets 2008 are attached to each magnet retaining member 2004 within each channel 2006 to apply a magnetic force to one of the first flange 1704 or the second flange 1706. An interior profile of each channel 2006 corresponds to an exterior profile of the first flange 1706 or the second flange 1706 such that when the motor 1800 or the motor 1900 moves the magnet member 2000 towards the first flange 1704 and the second flange 1706, a portion of each flange 1704, 1706 is disposed in one channel 2006. In this configuration, a greater amount of magnetic force may be applied by the magnets 2008 to the first and second flanges 1704, 1706 of the coupling 1700 relative to the magnetic force applied to the flange 1606 of the coupling 1600 by the brake 1532 of FIG. 16 or 17. A greater amount of magnetic force applied to the coupling 1700 may more quickly slow the rotation of the tread to a desired speed. In other embodiments, two couplings 1600 may be attached to the front axle 1502 or the rear axle 1504 to more quickly slow rotation of the tread when desired. In such embodiments, each coupling 1600 may correspond to a separate brake 1532 of FIG. 16 or FIG. 17.

Figure 19:
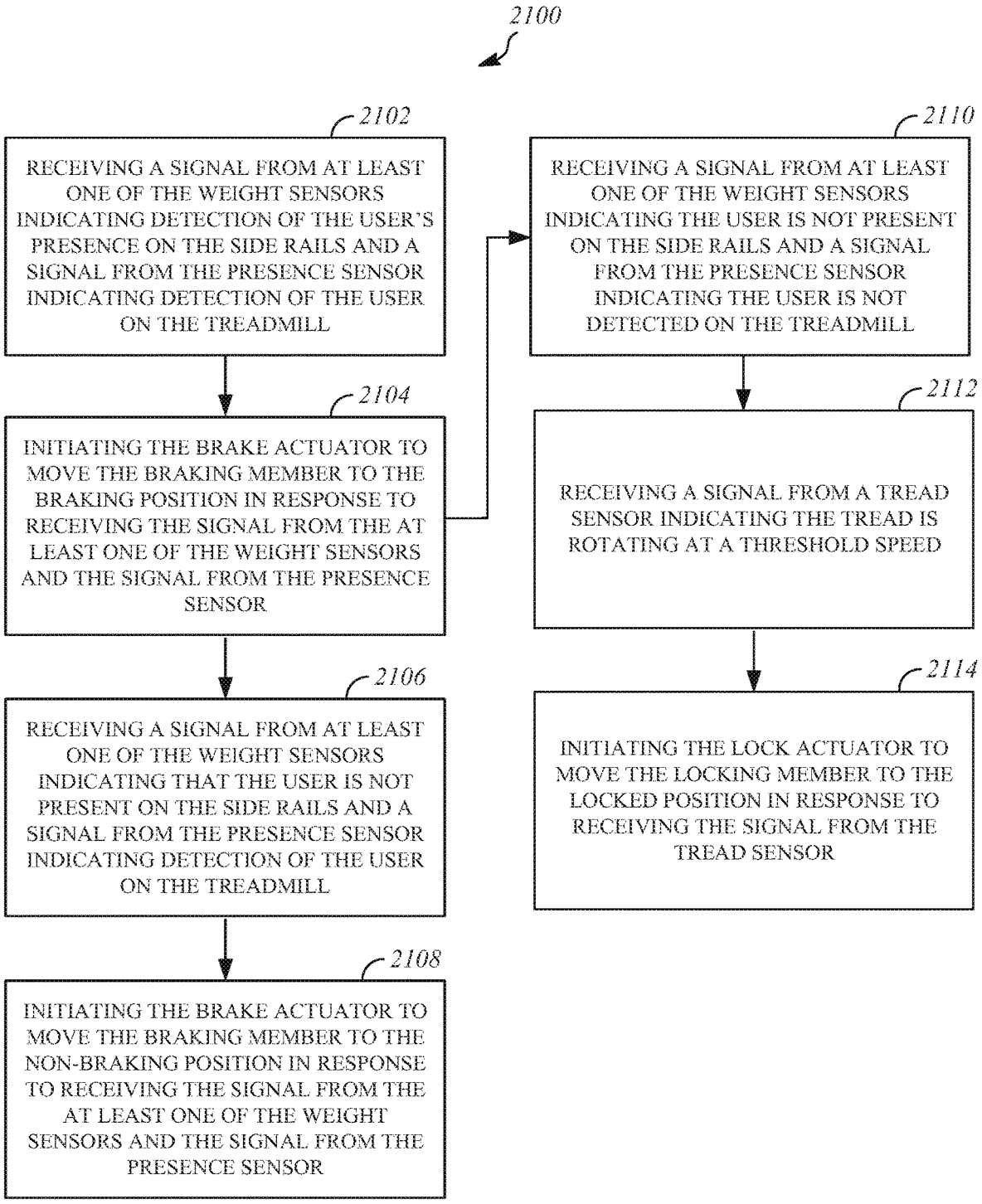
FIG. 19 is a flow diagram of a process for operating a braking system while a user is operating the treadmill of FIG. 13.

FIG. 19 is a flow diagram of a process 2100 for operating the braking system 1530 while a user is operating the treadmill 1500. At operation 2102, the controller 1524 receives a signal from at least one of the weight sensors indicating detection of the user's presence on at least one of the side rails (e.g., the side rails 106) and a signal from the presence sensor indicating detection of the user in an area of the tread (e.g., above the tread) and/or side rails suggesting an intent to use the treadmill (e.g., the user has stepped off of the tread and onto the side rails for a rest, drink, to talk on the phone, etc. but has not left the treadmill). Alternative to the second presence sensor indicating detection of the user above the tread, the controller may receive indication that the tread is moving, such as from the tread speed sensor. This would indicate that the user was on the tread to manually move the tread. At operation 2104, the controller 1524 initiates the actuator 1539 to move the braking member 1537 to the braking position to slow rotation of the tread in response to receiving the signal from the at least one of the weight sensors and the signal from the presence sensor. The braking member 1537 may slow the tread until the tread reaches a threshold speed, until the user or the controller 1524 initiates a command to move the braking member 1537 to the non-braking position, or until the tread comes to a complete stop.

If the user gets back on the tread, stepping off of the side rails, then at operation 2106, the controller 1524 receives a signal from the at least one of the weight sensors indicating that the user is not present on the side rails and a signal from the presence sensor indicating detection of the user in an area of the tread suggesting an intent to use the treadmill (e.g., the user has stepped back onto the tread). At operation 2108, the controller 1524 initiates the actuator 1539 to move the braking member 1537 to the non-braking position in response to receiving the signal from the at least one of the weight sensors indicating that the user is not present on the side rails and the signal from the presence sensor indicating detection of the user in the area of the tread suggesting an intent to use the treadmill.

If the user has decided to dismount the treadmill or has fallen off the treadmill, then at operation 2110, the controller 1524 receives a signal from at least one of the weight sensors indicating the user is not present on the side rails and a signal from the presence sensor indicating the user is not detected in an area of the tread and/or side rails suggesting an intent to use the treadmill (e.g., the user has stepped off of the side rails and has left the treadmill). At operation 2112, the controller 1524 receives a signal from the tread sensor 1531 indicating that the tread is rotating at a threshold speed (e.g., 1 mph) or lower. The brake 1532 may slow rotation of the tread to the threshold speed within 10 seconds or less. At operation 2114, when the threshold is met, the controller 1524 initiates the actuator 1540 to move the locking member 1538 to the locked position to stop rotation of the tread in response to receiving the signal from the tread sensor 1531. The teeth 1705 on the brake, if used, will also prevent the belt and slats from slipping is one were to step on the tread with the lock in the locked position.

Figure 20:
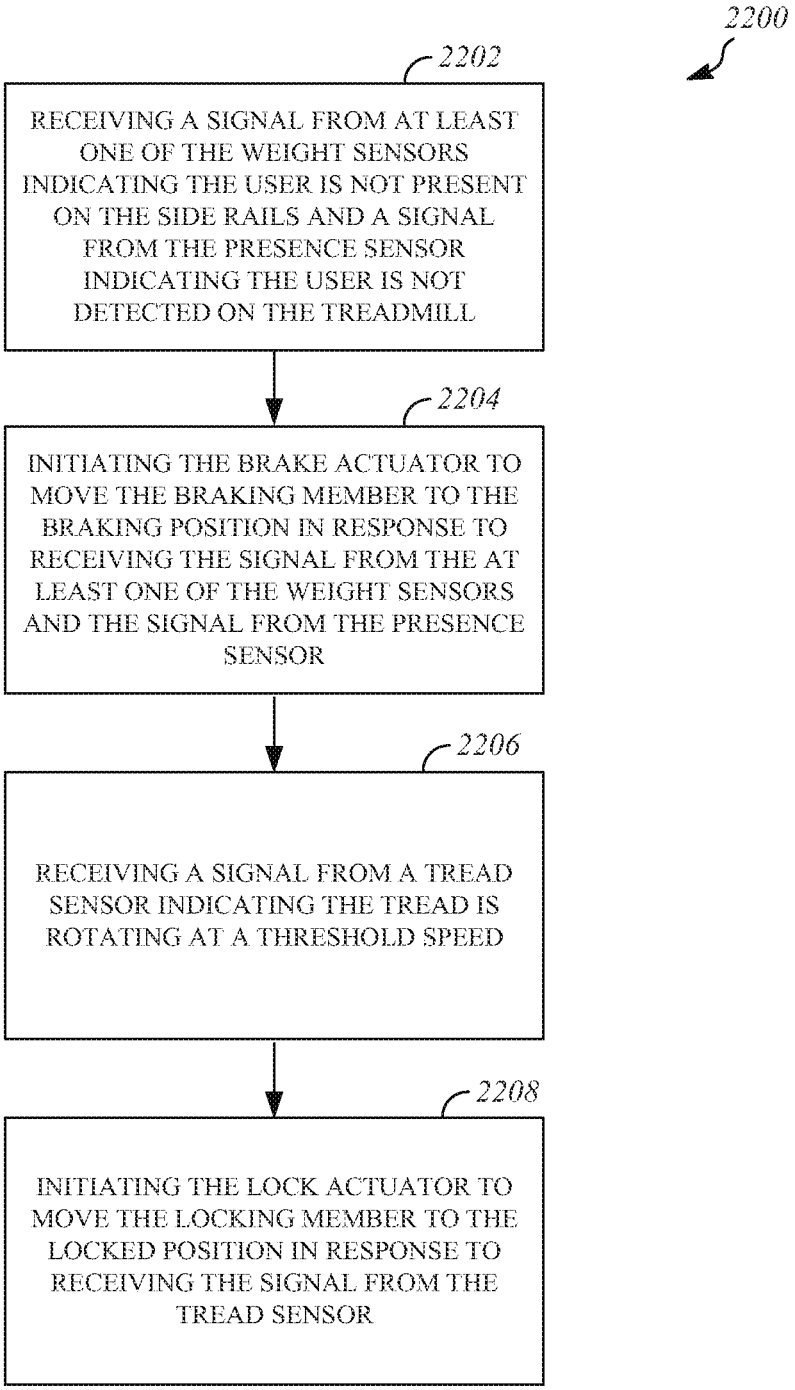
FIG. 20 is a flow diagram of another process for operating the braking system while the user is operating the treadmill.

FIG. 20 is a flow diagram of a process 2200 for operating the braking system 1530 while a user is operating the treadmill 1500. At operation 2202, the controller 1524 receives a signal from at least one of the weight sensors indicating the user is not present on the side rails and a signal from the presence sensor indicating the user is not detected in an area of the tread and/or side rails suggesting an intent to use the treadmill (e.g., the user has stepped off of the tread and has left the treadmill without stepping on the side rails). At operation 2204, the controller 1524 initiates the actuator 1539 to move the braking member 1537 to the braking position to slow rotation of the tread in response to receiving the signal from the at least one of the weight sensors and the signal from the presence sensor.

At operation 2206, the controller 1524 receives a signal from the tread sensor 1531 indicating that the tread has slowed to the threshold speed or lower. At operation 2208, the controller 1524 initiates the actuator 1540 to move the locking member 1538 to the locked position to stop rotation of the tread in response to receiving the signal from the tread sensor 1531. The teeth 1705 on the brake, if used, will also prevent the belt and slats from slipping is one were to step on the tread with the lock in the locked position. The controller 1524 may initiate the actuator 1540 to move the locking member 1538 to the unlocked position as previously described.

The braking system 1530 may be used to further control the speed and/or resistance of rotation of the tread during use. The user may enter a command using a display of the treadmill 1500 having features similar to those of the display 112 to move the braking member 1537 to the braking position directly in response to the command and while the user is using the treadmill. Additionally and/or alternatively, the command may be entered using a dial, a lever, a button, a switch, or any other user input device. In the braking position, the braking member 1537 may be used to add resistance to rotation of the tread to increase an intensity of the user's exercise. The user may also enter a command as described above to move the braking member 1537 to the non-braking position. For example, the braking member 1537 may be used to decrease resistance to the rotation of the tread to decrease the intensity of the user's exercise.

According to one example, the controller 1524 may adjust the resistance applied to the tread by adjusting the distance between the magnet member 1806 and the flange 1606 of FIG. 14 as previously described in response to receiving an input generated by the user. The user may set actuation of the braking member 1537 to the braking position and/or the non-braking position to occur immediately after a user input is received or may set actuation of the braking member 1537 to occur according to a predetermined and/or customized time sequence. These features may allow the user to create a customized exercise program. The user may also program control of the speed/resistance prior to beginning exercise or select from a menu of predetermined programs. The user may set a maximum speed of rotation for the manual treadmill, as manual treadmills may speed up due to kinetic energy, and the user may not be able to keep up. A program may be developed with the magnetic brake to initiate braking based on both speed and one or more biometrics. For example, if body temperature is detected above a threshold by the infrared temperature sensor and the speed of the tread is greater than a predetermined speed, the brake may be automatically applied.

Figure 21:
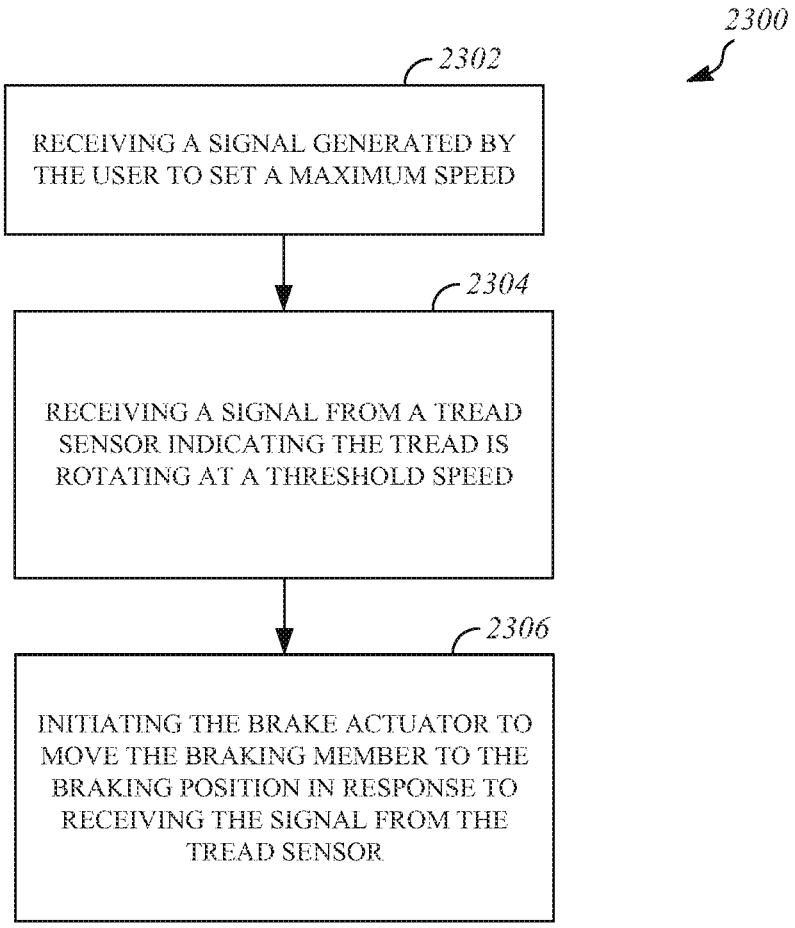
FIG. 21 is a flow diagram of a process for operating the braking system to set a maximum speed.

FIG. 21 is a flow diagram of a process 2300 for operating the braking system 1530 to set a maximum speed. At operation 2302, the controller 1524 receives a command generated by the user to set a maximum speed. The user may generate the command before operating the treadmill or while operating the treadmill. Additionally and/or alternatively, the controller 1524 may include a memory configured to store a user profile associated with a maximum speed previously selected by the user. In other embodiments, the user profile may be stored on any other device or server. The controller 1524 may automatically select the user's associated maximum speed in response to receiving an identification code associated with the user. At operation 2304, the controller 1524 receives a signal from the tread sensor 1531 indicating that the tread is rotating at the maximum speed. At operation 2306, the controller 1524 initiates the actuator 1539 to move the braking member 1537 to the braking position to prevent the tread from rotating at a speed faster than the maximum speed in response to receiving the signal from the tread sensor 1531. In some embodiments, the controller 1524 may initiate the actuator 1539 to move the braking member 1537 to the braking position to prevent the tread from rotating at a speed faster than a predetermined maximum speed that may or may not be set or changed by the user, but may be preprogrammed by the manufacturer or owner of facility in which the treadmill is used for safety purposes.

The lock and brake systems described herein can be used as described herein as a lock alone or brake/lock combination (FIG. 20, for example) when one or more of the sensors 116, 118, 120 sense that the user is no longer on the treadmill 100. These auto lock systems would inhibit or prohibit any movement of the front axle 300, front axle drum 304, wheel 338, and thus the tread 102 while the treadmill 100 is not in use. The lock and brake/lock systems can be used on the rear axle 302 or rear axle drum 306 instead of or with the front axle 300 or front axle drum 304. On a manual treadmill 100, the lock and brake/lock systems inhibit or prohibit movement in both directions while the lock is engaged, while allowing movement of the front axle 300, front axle drum 304, wheel 338, and thus the tread 102 in either direction when the lock is not engaged, so long as free turning roller bearings are used. This also allows the user to use the treadmill 100 as a sled, electing which direction in which the user will move the tread 102.

Figure 22:
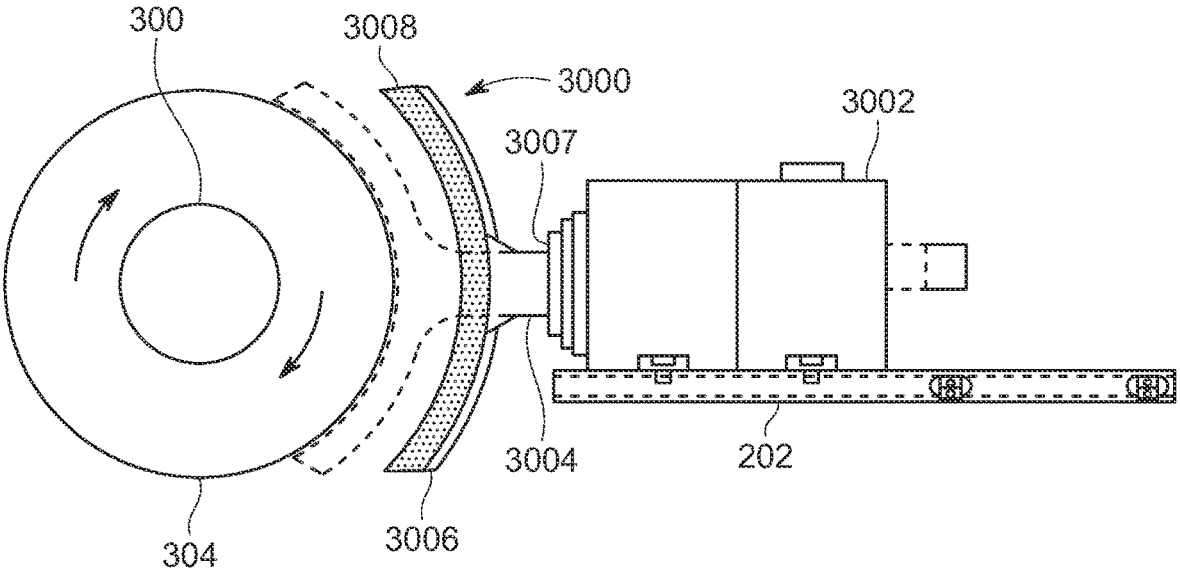
FIG. 22 is a side view of an auto lock system for a manual treadmill.

As alternatives to the lock 400 of FIG. 4, auto lock systems are disclosed. As examples, locking mechanism 3000 in FIG. 22 or locking mechanism 3100 in FIG. 23 can be used. In FIG. 22, locking mechanism 3000 is similar to the brake 700 of FIG. 7 but is used as a locking mechanism to inhibit rotation of an axle or axle drum. Although the examples refer to the front axle, the auto lock systems disclosed herein can be used on the rear axle or on both axles. The locking mechanism 3000 is attached to the frame 202 at an appropriate position. The locking mechanism 3000 includes an actuator 3002 configured to move a movable arm 3004 on which locking device 3006 is attached to a distal end 3007 of the movable arm 3004. Any type of mechanical, electromechanical, hydraulic, pneumatic, piezoelectric, or rotation-to-linear actuator may be used. In this implementation the locking device 3006 is a brake pad retainer with a brake pad 3008 attached to the brake pad retainer, the brake pad 3008 facing the front axle drum 304. The brake pad 3008 can be rubber or ceramic or the like. The actuator 3002 is powered by battery 310 or other power source to move the arm 3004 until the brake pad 3008 is in contact with the front axle drum 304. The locking mechanism 3000 is actuated by controller 1524 (not shown) when one or more of the sensors 116, 118, 120 sense that the user is no longer on the treadmill 100. When the front axle drum 304 stops rotating, power to the actuator 3002 is cut but the brake pad 3008 continues to contact the front axle drum 304, inhibiting rotation of the front axle drum 304 in either direction while the treadmill 10 is not in use. The actuator 3002 is only reengaged to remove the brake pad 3008 from the front axle drum 304 when the treadmill 100 is properly activated, which may include one or more of the sensors 116, 118, 120 sensing that a user is on the treadmill 100 and/or a passcode entry by the user into the display 112.

Figure 23:
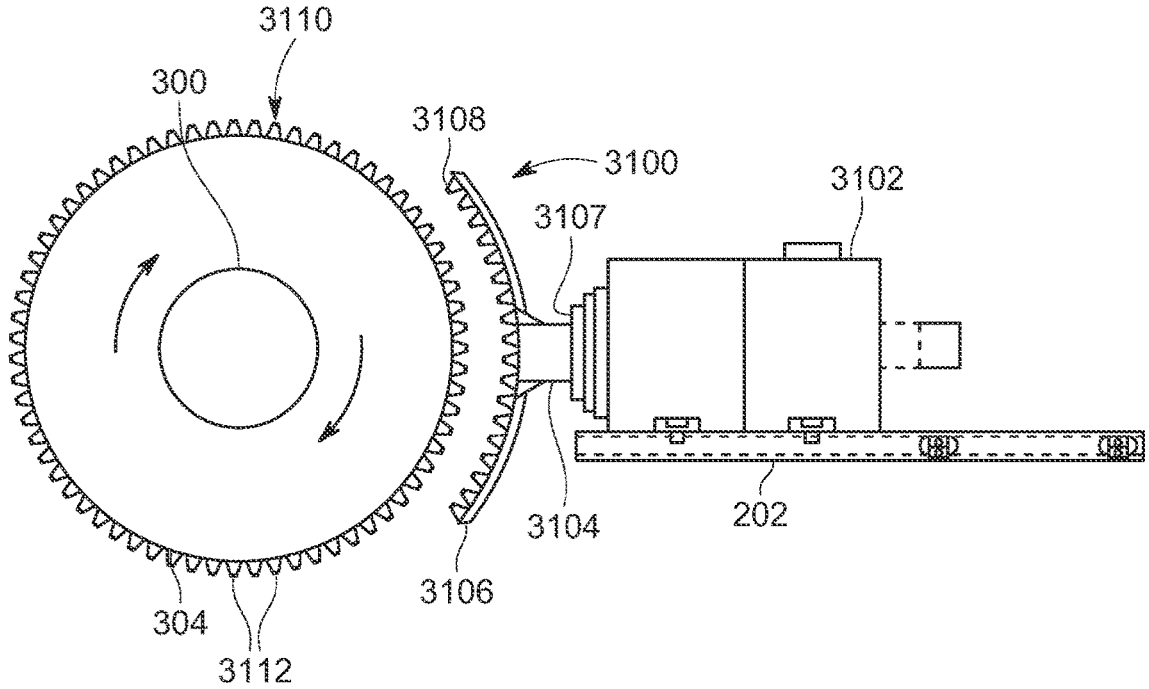
FIG. 23 is a side view of another aspect of the auto lock system for the manual treadmill of FIG. 22.

The locking mechanism 3100 of FIG. 23 operates in the same manner as the locking mechanism 3000 of FIG. 22, except that the locking mechanism 3100 inhibits or prohibits movement of the axle or axle drum and wheel from movement using engagement of teeth. The locking mechanism 3100 has an actuator 3102 configured to move a movable arm 3104 on which a locking device 3106 is attached to its distal end 3107. The locking device 3106 has a first set of teeth 3108 facing the front axle drum 304. The number and shape of the teeth 3108 are provided by means of example and can vary. Attached to the front axle drum 304 is a lock receiver 3110 surrounding the front axle drum 304 and having a second set of teach 3112 of a size and shape configured to engage with the first set of teeth 3108. The actuator 3102 is powered by battery 310 or other power source to move the arm 3104 until the first set of teeth 3108 engage the second set of teeth 3112 of the lock receiver 3110. The locking mechanism 3100 is actuated by the controller 1524 when one or more of the sensors 116, 118, 120 sense that the user is no longer on the treadmill 100. When the front axle drum 304 stops rotating, power to the actuator 3102 is cut but the first set of teeth 3108 continue to engage the lock receiver 3110, inhibiting or prohibiting rotation of the front axle drum 304 in either direction. The actuator 3102 is only reengaged to remove the first set of teeth 3008 from the lock receiver 3110 when the treadmill 100 is properly activated, which may include one or more of the sensors 116, 118, 120 sensing that a user is on the treadmill 100 and/or a passcode entry by the user into the display 112.

It should be noted that with the auto lock systems 3000, 3100, no sensing of a lack of user on the treadmill is necessarily required. The controller 5124 can alternatively detect that the front axle drum 304 has stopped rotating, or has stopped rotating for a threshold period of time, and then engage the auto lock systems 3000, 3100. The auto lock systems 3000, 3100 are engaged until the treadmill 100 is properly activated as described herein. As another alternative, the auto lock systems 3000, 1300 can simply be engaged by the user through the display when the user is done with the treadmill 100. The auto lock systems 3000, 3100 are engaged until the treadmill 100 is properly activated as described herein.

Figure 24:
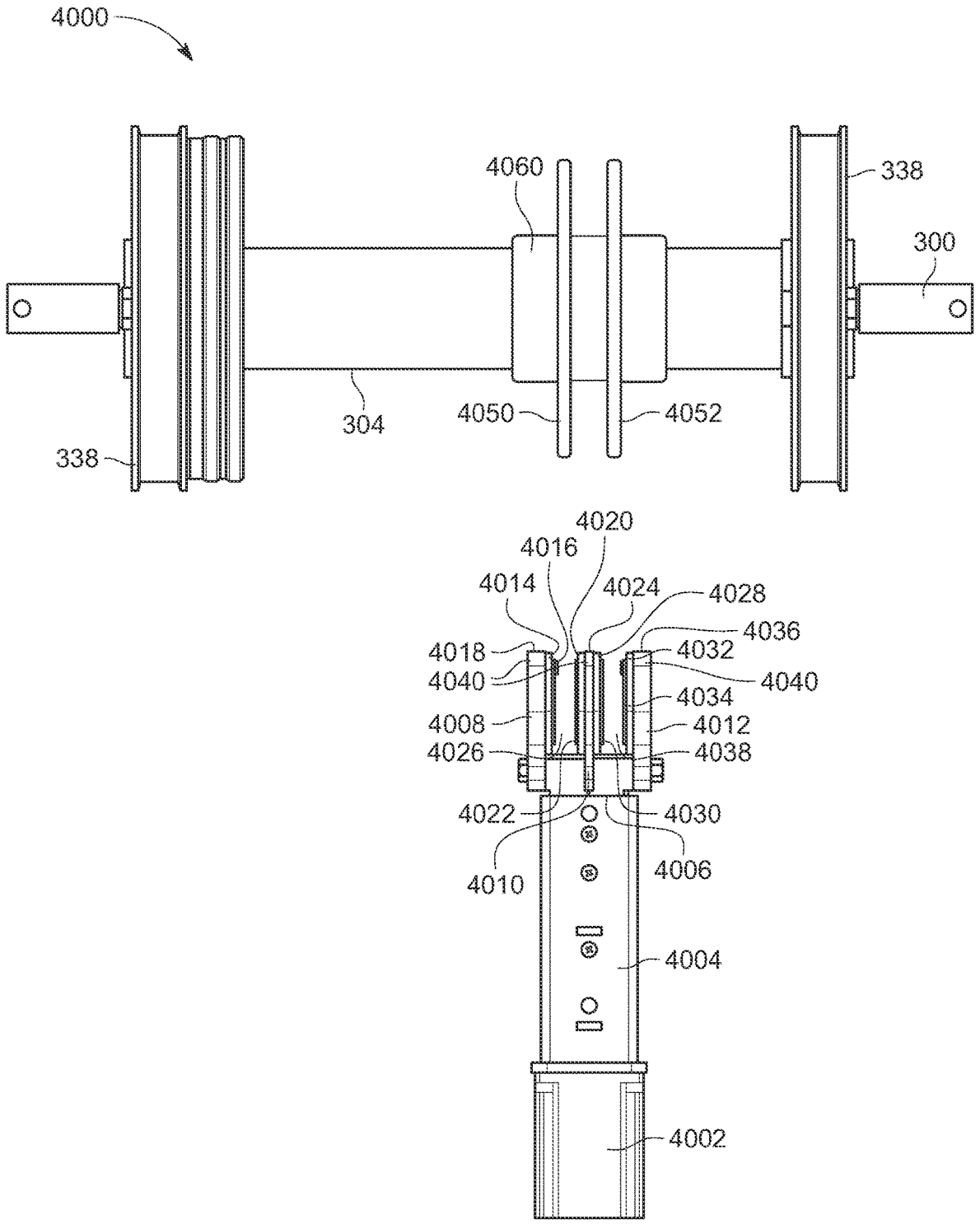
FIG. 24 is a plan view of another auto lock system for a manual treadmill, the auto lock system in a disengaged state.
Figure 25:
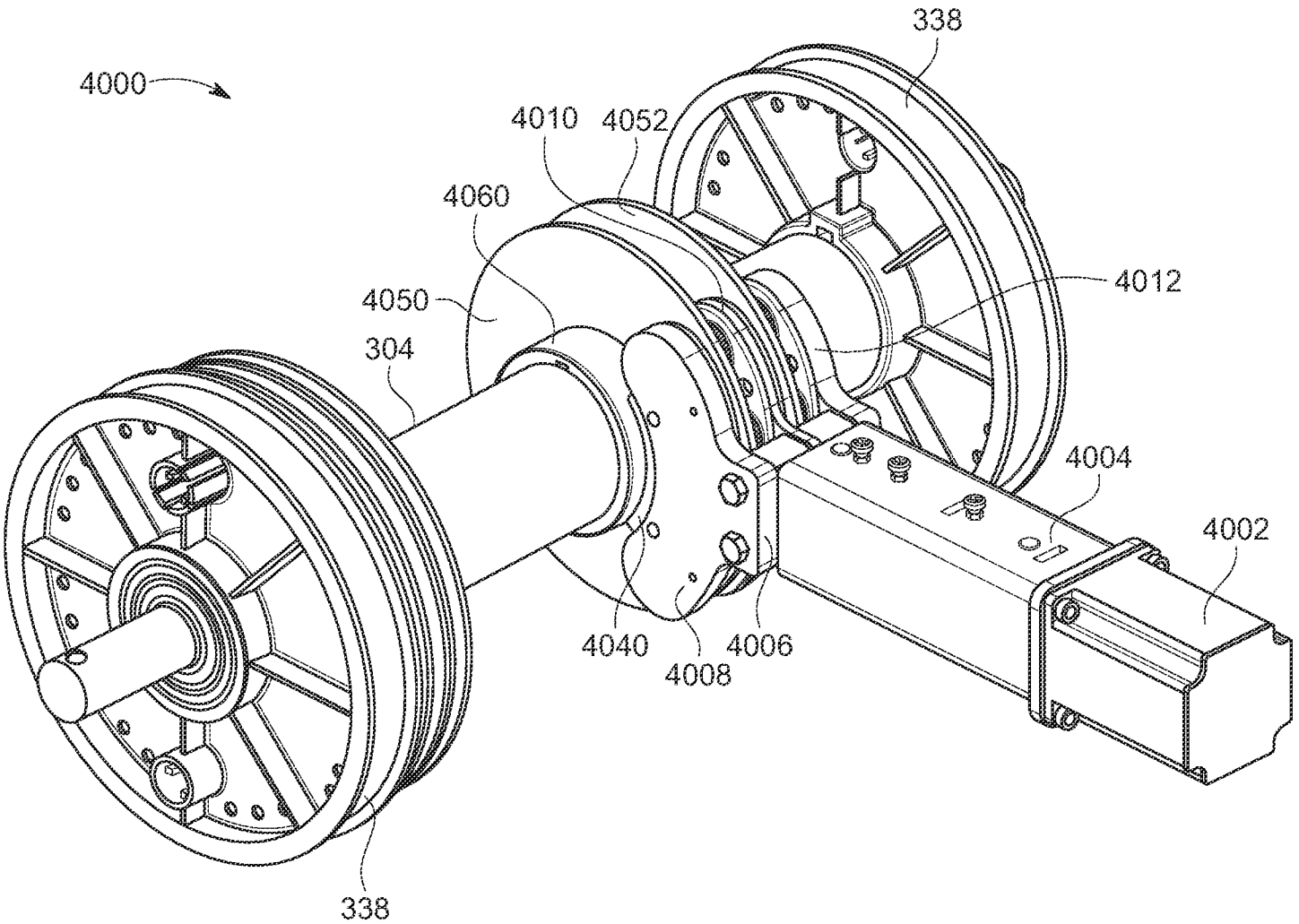
FIG. 25 is a perspective view of the auto lock system of FIG. 24 in an engaged state.

FIGS. 24 and 25 illustrate an auto lock system combining a magnetic brake and lock in one device and powered by a single motor or the battery 310. Any of the implementations of the magnetic brake in FIGS. 16-18 can be used. FIG. 24 illustrates an auto lock system with a magnetic brake combined with the locking mechanism of FIG. 22. The auto lock system 4000 of FIGS. 24 and 25 is attached to the frame 202 (not shown) and has an actuator 4002 configured to move a movable arm 4004. Any type of mechanical, electromechanical, hydraulic, pneumatic, piezoelectric, or rotation-to-linear actuator may be used. The movable arm 4004 has a distal end 4006 from which two or more members extend. In FIG. 16, there are two members and in FIG. 18, there are four members. In this implementation, there are three members, a first member 4008, a second member 4010, and a third member 4012. First member 4008 has a first surface 4014 carrying a first magnet 4016 and a first distal surface 4018 configured to engage the front axle drum 304 (or front axle when no drum is used). Second member 4010 has a second surface 4020 carrying a second magnet 4022 and a second distal surface 4024 configured to engage the front axle drum 304. The first surface 4014 faces the second surface 4020 to form a first channel 4026. The auto lock system 4000 will be described using the first member 4008 and second member 4010. However, any number of additional members operate in the same manner. As best shown in FIG. 24, second member 4010 also has a third surface 4028 carrying a third magnet 4030. Third member 4012 has a fourth surface 4032 carrying a fourth magnet 4034 and a third distal surface 4036 configured to engage the front axle drum 304. The third surface 4028 and the fourth surface 4032 face each other to form a second channel 4038. The magnets can be electromagnets, for example. The magnets can be neodymium magnets, small in size but with a force of about thirty pounds each. Any number of magnets can be used on each member. As a non-limiting example, 3-4 magnets are used on each of the first through fourth surfaces of the first through third members. This can provide nearly 500 pounds braking force.

In this implementation, as best seen in FIG. 25, the distal surfaces 4018, 4024 and 4036 are configured as a brake retainer with a brake pad 4040. The auto lock system 4000 further has a first flange 4050 attached around the front axle drum 304 and aligned with the first channel 4026 and a second flange 4052 attached around the front axle drum 304 and aligned with the second channel 4038. The number of flanges will vary with the number of channels. The flanges 4050, 4052 are of a material attracted to the magnets, such as copper, iron, or nickel. The controller 1524 (as previously described) is configured to, in response to one or more of the sensors 116, 118, 120 detecting no user on the manual treadmill, actuate the actuator 4002 to move the movable arm 4004 such that the first flange 4050 is received in the first channel 4026 and the second flange 4052 is received in the second channel 4038, the first magnet 4016 and second magnet 4022 slowing rotation of the front axle drum via magnetic force on the first flange 4050, and the third magnet 4030 and the fourth magnet 4034 slowing rotation of the front axle drum via magnetic force on the second flange 4052. When the rotation of the front axle drum 304 slows to a threshold amount, the controller 1524 will further actuate the actuator 4002 to move the movable arm 4004 so that the brake pads 4040 on the first, second and third distal surfaces 4018, 4024, 4036 engage the front axle drum 304, as shown in FIG. 25. The threshold amount can be, as examples, a 90%, 91%, 92%, 93%, 94%, 95%, 96%, 97%, 98%, 99% or 100% reduction in speed. As another example, the threshold amount can be equal to or less than one mile per hour. If needed to better accommodate engagement of the brake pads 4040 with the front axle drum 304 with respect to the first and second flanges 4050, 4052, an extender 4060 can be attached around the front axle drum 304 in alignment with each of the first member 4008, second member 4010 and third member 4012.

When the front axle drum 304 stops rotating, power to the actuator 4002 is cut but the brake pads 4040 continue to contact the front axle drum 304, inhibiting rotation of the front axle drum 304 in either direction while the treadmill 10 is not in use and without the need of any power source. The actuator 4002 is only reengaged to remove the brake pads 4040 from the front axle drum 304 when the treadmill 100 is properly activated, which may include one or more of the sensors 113, 116, 118, 120 sensing that a user is on the treadmill 100 and/or a passcode entry by the user into the display 112.

Figure 26:
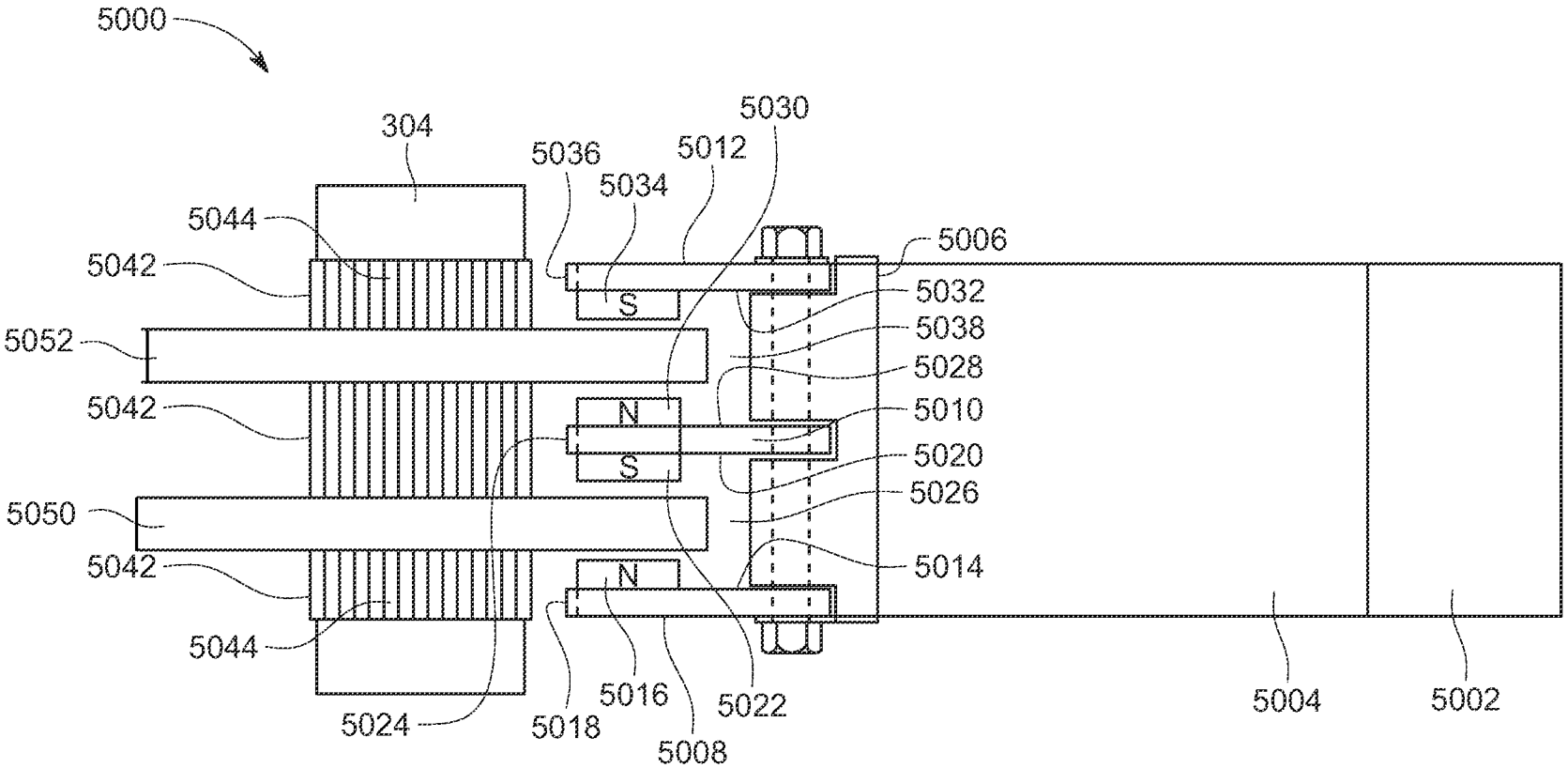
FIG. 26 is a plan view of another aspect of the auto lock system of FIG. 24.
Figure 27:
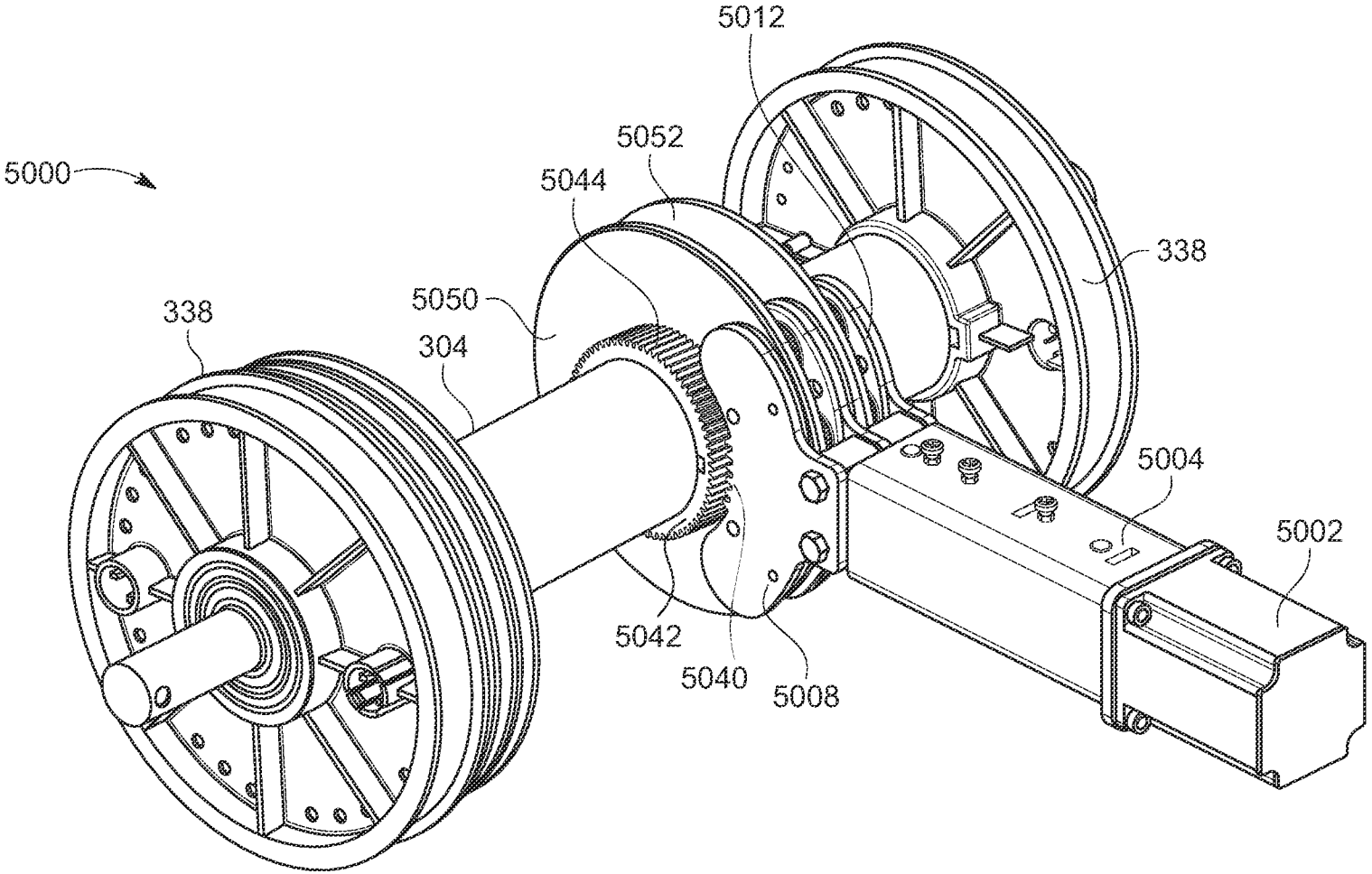
FIG. 27 is a perspective view of the auto lock system of FIG. 26.

FIGS. 26 and 27 illustrate another auto lock system combining a magnetic brake and lock in one device and powered by a single motor or the battery 310. Any of the implementations of the magnetic brake in FIGS. 16-18 can be used. FIG. 26 illustrates an auto lock system with a magnetic brake combined with the locking mechanism of FIG. 23. The auto lock system 5000 of FIGS. 26 and 27 is attached to the frame 202 (not shown) and has an actuator 5002 configured to move a movable arm 5004. Any type of mechanical, electromechanical, hydraulic, pneumatic, piezoelectric, or rotation-to-linear actuator may be used. The movable arm 5004 has a distal end 5006 from which two or more members extend. In FIG. 16, there are two members and in FIG. 18, there are four members. In this implementation, there are three members, a first member 5008, a second member 5010, and a third member 5012. First member 5008 has a first surface 5014 carrying a first magnet 5016 and a first distal surface 5018 configured to engage the front axle drum 304 (or front axle when no drum is used). Second member 5010 has a second surface 5020 carrying a second magnet 5022 and a second distal surface 5024 configured to engage the front axle drum 304. The first surface 5014 faces the second surface 5020 to form a first channel 5026. As best shown in FIG. 26, second member 5010 also has a third surface 5028 carrying a third magnet 5030. Third member 5012 has a fourth surface 5032 carrying a fourth magnet 5034 and a third distal surface 5036 configured to engage the front axle drum 304. The third surface 5028 and the fourth surface 5032 face each other to form a second channel 5038.

Figure 28:
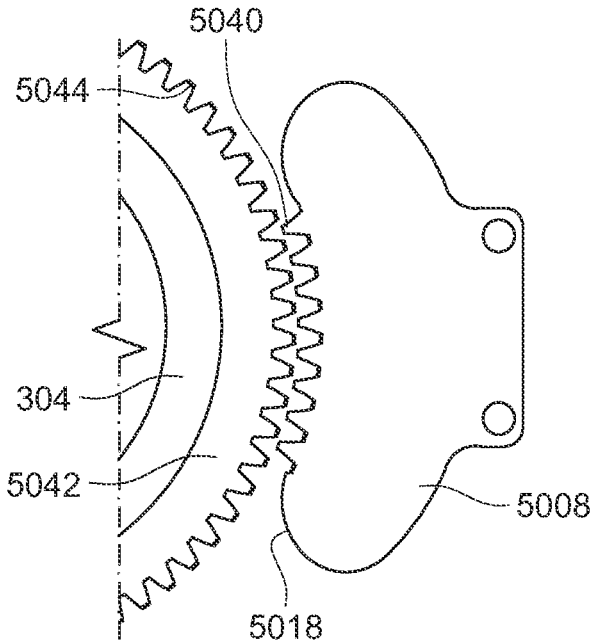
FIG. 28 is a side view of the first set of teeth and the second set of teeth of FIGS. 26 and 27 for clarity.

In this implementation, the distal surfaces 5018, 5024 and 5036 are configured with a first set of teeth 5040, best seen in FIGS. 27 and 28. A locking receiver 5042 surrounds the front axle drum 304 and is aligned with one or more of the first, second and third distal surfaces 5018, 5024, 5036. In FIGS. 26 and 27, there is shown a locking receiver 5042 aligned with each of the first, second and third distal surfaces 5018, 5024, 5036. However, this is not required and one locking receiver or two locking receivers may be used. Only the distal surfaces aligned with a locking receiver require the first set of teeth 5040. Each locking receiver 5042 has a second set of teeth 5044. The teeth are similar to those described with respect to FIG. 23.

The auto lock system 5000 further has a first flange 5050 attached around the front axle drum 304 and aligned with the first channel 5026 and a second flange 5052 attached around the front axle drum 304 and aligned with the second channel 5038. The number of flanges will vary with the number of channels. The flanges 5050, 5052 are of a material attracted to the magnets, such as copper, iron, or nickel. The controller 1524 (as previously described) is configured to, in response to one or more of the sensors 113, 116, 118, 120 detecting no user on the manual treadmill, actuate the actuator 5002 to move the movable arm 5004 such that the first flange 5050 is received in the first channel 5026 and the second flange 5052 is received in the second channel 5038, the first magnet 5016 and second magnet 5022 slowing rotation of the front axle drum via magnetic force on the first flange 5050, and the third magnet 5030 and the fourth magnet 5034 slowing rotation of the front axle drum via magnetic force on the second flange 5052. When the rotation of the front axle drum 304 slows to a threshold amount, the controller 1524 will further actuate the actuator 5002 to move the movable arm 5004 so that the first set of teeth 5040 on the first, second and third distal surfaces 5018, 5024, 5036 engage the second set of teeth 5044 of a respective locking receiver 5042, as shown in FIG. 27. The threshold amount can be, as examples, a 90%, 91%, 92%, 93%, 94%, 95%, 96%, 97%, 98%, 99% or 100% reduction in speed. As another example, the threshold amount can be equal to or less than one mile per hour.

When the front axle drum 304 stops rotating, power to the actuator 5002 is cut but the first set of teeth 5040 and the second set of teeth 5044 remain engaged, inhibiting or prohibiting rotation of the front axle drum 304 in either direction while the treadmill 10 is not in use, without requiring any power source. The actuator 5002 is only reactivated to disengage the first set of teeth 5040 and the second set of teeth 5044 when the treadmill 100 is properly activated, which may include one or more of the sensors 113, 116, 118, 120 sensing that a user is on the treadmill 100 and/or a passcode entry by the user into the display 112.

It should be noted that with the auto lock systems 4000, 5000, no sensing of a lack of user on the treadmill is necessarily required. The controller 5124 can alternatively detect that the front axle drum 304 has stopped rotating, or has stopped rotating for a particular period of time, and then engage the auto lock systems 4000, 5000. The auto lock systems 4000, 5000 are aged until the treadmill 100 is properly activated as described herein. As another alternative, the auto lock systems 4000, 5000 can simply be engaged by the user through the display when the user is done with the treadmill 100. The auto lock systems 4000, 5000 are engaged until the treadmill 100 is properly activated as described herein.

Figure 29:
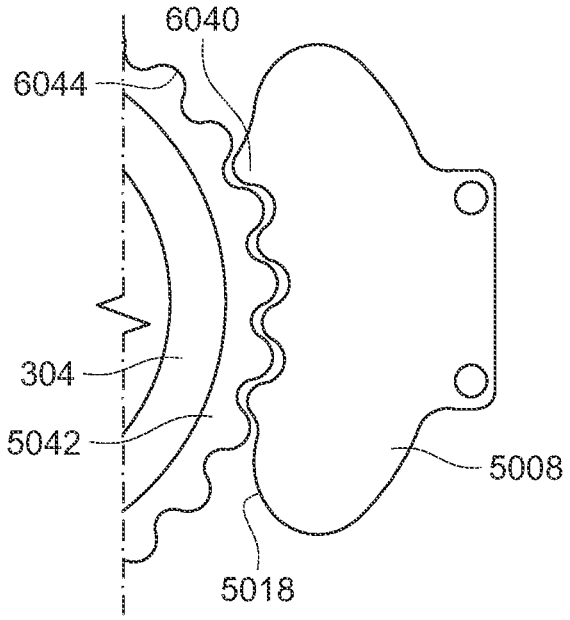
FIG. 29 is a side view illustrating another aspect of the teeth of the auto lock system of FIG. 23 or 26.

FIG. 29 is an example of another shape of teeth. In FIG. 29, first member 5008 is illustrated with a first distal surface 5018 having a first set of teeth 6040 of a different shape. Locking receiver 5042 has a second set of teeth 6044 that are shaped to engage the first set of teeth 6040.

The word "example" is used herein to mean serving as an example, instance, or illustration. Any aspect or design described herein as "example" is not necessarily to be construed as preferred or advantageous over other aspects or designs. Rather, use of the word "example" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment or implementation unless described as such.

Implementations of the controller 314, controller 1524, and any other controller described herein (and the algorithms, methods, instructions, etc., stored thereon and/or executed thereby) can be realized in hardware, software, or any combination thereof. The hardware can include, for example, computers, intellectual property (IP) cores, application-specific integrated circuits (ASICs), programmable logic arrays, optical processors, programmable logic controllers, microcode, microcontrollers, servers, microprocessors, digital signal processors or any other suitable circuit. The terms "signal" and "data" are used interchangeably. Further, portions of the controller 314 or any other described controller do not necessarily have to be implemented in the same manner.

Further, in one aspect, for example, the controller 314 can be implemented using a general-purpose computer or general-purpose processor with a computer program that, when executed, carries out any of the respective methods, algorithms and/or instructions described herein. In addition, or alternatively, for example, a special purpose computer/processor can be utilized which can contain other hardware for carrying out any of the methods, algorithms, or instructions described herein.

Further, all or a portion of implementations of the present disclosure can take the form of a computer program product accessible from, for example, a computer-usable or computer-readable medium. A computer-usable or computer-readable medium can be any device that can, for example, tangibly contain, store, communicate, or transport the program for use by or in connection with any processor. The medium can be, for example, an electronic, magnetic, optical, electromagnetic, or a semiconductor device. Other suitable mediums are also available.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An auto lock system for a manual treadmill, the manual treadmill including a tread that rotates on front wheels supported on a front axle and rear wheels supported on a rear axle, the auto lock system comprising:

a locking mechanism comprising:

a movable arm having a distal end facing one of the front axle or the rear axle;

a locking device at the distal end of the movable arm configured to engage the one of the front axle or the rear axle to inhibit rotation of respective front wheels or rear wheels; and an actuator configured to move the movable arm;

a controller; and a sensor in communication with the controller and configured to detect a user on the manual treadmill, wherein the controller is configured to:

in response to the sensor detecting no user on the manual treadmill, actuate the actuator to move the movable arm such that the locking device engages the one of the front axle or the rear axle.

2. The auto lock system of claim 1, wherein the controller is further configured to:

in response to detecting the user on the manual treadmill, actuate the actuator to move the movable arm to remove the locking device from contact with the one of the front axle or the rear axle.

3. The auto lock system of claim 2, further comprising a display in communication with the controller, wherein detecting the user on the manual treadmill comprises detecting a user input into the display.

4. The auto lock system of claim 1, wherein the locking device is a brake pad retainer with a brake pad.

5. The auto lock system of claim 1, further comprising a locking receiver surrounding the one of the front axle or the rear axle and aligned with the locking device, the locking device having a first set of teeth and the locking receiver having a second set of teeth, such that when the locking device engages the one of the front axle or the rear axle, the first set of teeth engage with the second set of teeth to prevent movement of respective front wheels or rear wheels.

6. The auto lock system of claim 1, wherein the locking device comprises:

a first member extending from the distal end of the movable arm and having a first surface carrying a first magnet and a first distal surface configured to engage the one of the front axle or the rear axle; and a second member extending from the distal end of the movable arm and having a second surface carrying a second magnet a second distal surface configured to engage the one of the front axle or the rear axle, the first surface facing the second surface to form a channel, the auto lock system further comprising:

a flange surrounding the one of the front axle or the rear axle and aligned with the channel, wherein the controller is further configured to:

in response to the sensor detecting no user on the manual treadmill, actuate the actuator to move the movable arm such that the flange is received in the channel, the first magnet and the second magnet slowing rotation of the one of the front axle or the rear axle via magnetic force on the flange; and when the rotation of the one of the first axle or the second axle slows to a threshold amount, further actuate the actuator to move the movable arm so that the first distal surface and the second distal surface engage the one of the front axle or the rear axle.

7. The auto lock system of claim 6, wherein the first distal surface and the second distal surface are each configured as a brake pad retainer with a brake pad.

8. The auto lock system of claim 6, further comprising a locking receiver surrounding the one of the front axle or the rear axle and aligned with the first distal surface or the second distal surface, a respective distal surface having a first set of teeth and the locking receiver having a second set of teeth, such that when the respective distal surface engages the one of the front axle or the rear axle, the first set of teeth engage with the second set of teeth to prevent movement of the respective front wheels or rear wheels.

9. The auto lock system of claim 8, wherein the locking receiver is aligned with both the first distal surface and the second distal surface.

10. The auto lock system of claim 1, wherein the tread comprises individual slats, the system further comprising:

a light carried by a slat, the light configured to be powered when the display is powered.

11. The auto lock system of claim 1, wherein the tread comprises individual slats, the system further comprising:

a light carried by a slat, the light powered when the tread is rotated.

12. An auto lock system for a manual treadmill, the manual treadmill including a tread that rotates on front wheels supported on a front axle and rear wheels supported on a rear axle, the auto lock system comprising:

a locking mechanism having a disengaged position in which the locking mechanism is not engaged with the front axle or the rear axle, the front axle and the rear axle configured to move in both a forward direction and a rearward direction, and an engaged position in which the locking mechanism engages the front axle or the rear axle, inhibiting or preventing movement of the respective front axle or rear axle in both the forward direction and the rearward direction;

an actuator configured to move the locking mechanism between the disengaged position and the engaged position; and a controller configured to:

in response detecting an input indicating that the front axle or the rear axle are no longer moving, actuate the actuator to move the locking mechanism from the disengaged position to the engaged position.

13. The auto lock system of claim 12, wherein the input detected by the controller is a speed of one of the tread or front axle or rear axle of zero.

14. The auto lock system of claim 12, wherein the input detected by the controller is a speed of one of the tread or front axle or rear axle of zero for a threshold period of time.

15. The auto lock system of claim 12, wherein the input detected by the controller is an input by a user into a display in communication with the controller to engage the locking mechanism.

16. The auto lock system of claim 15, wherein the controller is further configured to:

in response to another user input into the display, disengaging the locking mechanism.

17. The auto lock system of claim 12, further comprising a sensor in communication with the controller and configured to detect a user on the manual treadmill, wherein the input is received from the sensor that no user is on the manual treadmill.

18. The auto lock system of claim 17, wherein the controller is further configured to:

in response to the sensor detecting the user on the manual treadmill, actuate the actuator to move the movable arm to remove the locking mechanism from contact with the one of the front axle or the rear axle.

19. The auto lock system of claim 12, wherein the tread comprises individual slats, the system further comprising:

a light carried by a slat, the light configured to be powered when the display is powered.

20. The auto lock system of claim 12, wherein the tread comprises individual slats, the system further comprising:

a light carried by a slat, the light powered when the tread is rotated.

21. An auto lock system for a manual treadmill, the manual treadmill including a tread that rotates on front wheels supported on a front axle and rear wheels supported on a rear axle, the auto lock system comprising:

a locking mechanism comprising:

a movable arm having a distal end facing one of the front axle or the rear axle;

a locking device at the distal end of the movable arm, a first member extending from the distal end of the movable arm and having a first surface carrying a first magnet and a first distal surface configured to engage the one of the front axle or the rear axle; and a second member extending from the distal end of the movable arm and having a second surface carrying a second magnet a second distal surface configured to engage the one of the front axle or the rear axle, the first surface facing the second surface to form a channel; and an actuator configured to move the movable arm;

a flange surrounding the one of the front axle or the rear axle and aligned with the channel;

a controller; and a sensor in communication with the controller and configured to detect a user on the manual treadmill, wherein the controller is configured to:

in response to the sensor detecting no user on the manual treadmill, actuate the actuator to move the movable arm such that the flange is received in the channel, the first magnet and the second magnet slowing rotation of the one of the front axle or the rear axle via magnetic force on the flange; and when the rotation of the one of the first axle or the second axle slows to a threshold amount, further actuate the actuator to move the movable arm so that the first distal surface and the second distal surface engage the one of the front axle or the rear axle.

22. The auto lock system of claim 21, wherein the first distal surface and the second distal surface are each configured as a brake pad retainer with a brake pad.

23. The auto lock system of claim 21, further comprising a locking receiver surrounding the one of the front axle or the rear axle and aligned with the first distal surface or the second distal surface, a respective distal surface having a first set of teeth and the locking receiver having a second set of teeth, such that when the respective distal surface engages the one of the front axle or the rear axle, the first set of teeth engage with the second set of teeth to prevent movement of the respective front wheels or rear wheels.

* * * * *